US010799415B2

(12) United States Patent
Mayer et al.

(10) Patent No.: US 10,799,415 B2
(45) Date of Patent: Oct. 13, 2020

(54) SPRING-DRIVEN FOOT COMPRESSION SYSTEM

(71) Applicant: AVEX, LLC, Grand Junction, CO (US)

(72) Inventors: Matthew J. Mayer, Grand Junction, CO (US); Gerhard B Rill, Parachute, CO (US)

(73) Assignee: Avex, LLC, Grand Junction, CO (US)

( * ) Notice: Subject to any disclaimer, the term of this patent is extended or adjusted under 35 U.S.C. 154(b) by 930 days.

(21) Appl. No.: 14/362,108

(22) PCT Filed: Nov. 30, 2012

(86) PCT No.: PCT/US2012/067365
§ 371 (c)(1),
(2) Date: May 30, 2014

(87) PCT Pub. No.: WO2013/082473
PCT Pub. Date: Jun. 6, 2013

(65) Prior Publication Data

US 2014/0316313 A1 Oct. 23, 2014

Related U.S. Application Data

(60) Provisional application No. 61/566,482, filed on Dec. 2, 2011.

(51) Int. Cl.

| | |
|---|---|
| ***A61H 1/00*** | (2006.01) |
| ***A43B 7/14*** | (2006.01) |
| ***A43B 3/00*** | (2006.01) |

(52) U.S. Cl.
CPC ..... *A61H 1/008* (2013.01); *A43B 3/0015* (2013.01); *A43B 7/146* (2013.01); *A43B 7/147* (2013.01);
(Continued)

(58) Field of Classification Search
CPC ..... A61H 1/008; A61H 2230/805; A61H 2201/0173; A61H 2201/1664;
(Continued)

(56) References Cited

U.S. PATENT DOCUMENTS

| | | | |
|---|---|---|---|
| 1,546,506 | A | 7/1925 | Naysmith |
| 2,397,428 | A | 3/1946 | Moshier |

(Continued)

FOREIGN PATENT DOCUMENTS

| | | |
|---|---|---|
| AT | 506689 | 11/2009 |
| CA | 2730238 | 5/2017 |

(Continued)

OTHER PUBLICATIONS

International Search Report and Written Opinion dated Jul. 29, 2016 for PCT/US2016/019236.

(Continued)

*Primary Examiner* — Colin W Stuart
*Assistant Examiner* — Douglas Y Sul
(74) *Attorney, Agent, or Firm* — Snell & Wilmer L.L.P.

(57) ABSTRACT

Methods and systems for dynamic compression of venous tissue enable improved blood movement in the extremities. In accordance with an exemplary embodiment, a pressure pad provides a compressive force to a portion of the human body. The pressure pad is successively withdrawn and re-pressed against the body. In this manner, prevention and/or treatment of various medical conditions may be achieved, for example restless leg syndrome, edema, plantar fasciitis, deep vein thrombosis, pulmonary embolism, venous insufficiency, wound care, and/or the like.

14 Claims, 17 Drawing Sheets

(52) U.S. Cl.
CPC ..... *A61H 1/005* (2013.01); *A61H 2201/0173* (2013.01); *A61H 2201/123* (2013.01); *A61H 2201/1215* (2013.01); *A61H 2201/149* (2013.01); *A61H 2201/165* (2013.01); *A61H 2201/1664* (2013.01); *A61H 2201/5028* (2013.01); *A61H 2201/5035* (2013.01); *A61H 2201/5038* (2013.01); *A61H 2201/5043* (2013.01); *A61H 2201/5071* (2013.01); *A61H 2201/5084* (2013.01); *A61H 2201/5097* (2013.01); *A61H 2205/12* (2013.01); *A61H 2230/805* (2013.01)

(58) Field of Classification Search
CPC ..... A61H 2201/123; A61H 2205/12; A61H 2201/149; A61H 2201/5028; A61H 23/006; A61H 23/02; A43B 3/0015; A43B 7/146; A43B 7/147
See application file for complete search history.

(56) References Cited

U.S. PATENT DOCUMENTS 2,836,174 A 5/1958 Infanger
3,512,522 A * 5/1970 Greenlee ..... A61H 31/006 601/106
3,612,043 A 10/1971 Inaki
3,888,242 A 6/1975 Harris et al.
3,917,261 A 11/1975 Small et al.
4,088,128 A * 5/1978 Mabuchi ..... A61H 23/0254 601/108
4,166,329 A 9/1979 Herbig
4,294,236 A 10/1981 Hofstein
4,299,206 A 11/1981 Hofstein
4,721,101 A 1/1988 Gardner et al.
4,747,396 A * 5/1988 Richardson ..... A61H 23/06 601/107
4,856,496 A 8/1989 Chursinoff
5,176,624 A 1/1993 Huehnreich
5,357,696 A 10/1994 Gray et al.
5,407,418 A 4/1995 Szpur
5,443,440 A 8/1995 Tumey et al.
5,584,798 A 12/1996 Fox
5,605,533 A 2/1997 Badilla
5,656,017 A * 8/1997 Keller ..... A61H 1/008 601/107
5,674,262 A 10/1997 Tumey et al.
5,682,690 A 11/1997 Chang
5,688,225 A 11/1997 Walker
5,931,797 A 8/1999 Tumey et al.
6,135,116 A 10/2000 Vogel et al.
6,205,618 B1 3/2001 Lee
6,234,987 B1 5/2001 Chen
6,319,215 B1 11/2001 Manor et al.
6,360,457 B1 3/2002 Qui et al.
6,585,669 B2 7/2003 Manor et al.
6,615,080 B1 9/2003 Unsworth et al.
6,685,661 B2 2/2004 Fox
6,702,768 B2 3/2004 Mano et al.
6,893,409 B1 5/2005 Lina
7,107,706 B1 9/2006 Bailey, Sr. et al.
7,188,439 B2 3/2007 DiBenedetto et al.
7,219,449 B1 5/2007 Hoffberg et al.
7,282,038 B2 10/2007 Gillis et al.
7,310,895 B2 12/2007 Whittlesey et al.
7,318,291 B2 1/2008 Wang et al.
7,395,614 B1 7/2008 Bailey, Sr. et al.
7,506,460 B2 3/2009 DiBenedetto et al.
7,544,173 B2 6/2009 Suzuki
7,596,891 B2 10/2009 Carnes et al.
7,607,243 B2 10/2009 Berner, Jr. et al.
7,618,382 B2 11/2009 Vogel et al.
7,631,382 B2 12/2009 DiBenedetto et al.
7,640,681 B2 * 1/2010 Yang ..... A61F 5/14 36/141
7,676,960 B2 3/2010 DiBenedetto et al.
7,909,783 B2 * 3/2011 Mayer ..... A61H 23/02 601/104
7,980,009 B2 7/2011 Carnes et al.
8,056,268 B2 11/2011 DiBenedetto et al.
8,246,556 B2 8/2012 Mayer et al.
8,308,665 B2 11/2012 Harry et al.
9,283,139 B2 * 3/2016 Mayer ..... A61H 23/02
9,439,828 B2 9/2016 Mayer et al.
9,757,302 B2 9/2017 Mayer
2002/0068884 A1 * 6/2002 Alviso ..... A61H 7/001 601/1
2002/0133106 A1 9/2002 Peled
2003/0139255 A1 7/2003 Lina
2004/0030270 A1 2/2004 Johnson
2004/0059386 A1 3/2004 Yu
2004/0064974 A1 4/2004 Schuster
2005/0039348 A1 2/2005 Raluy et al.
2005/0126049 A1 6/2005 Koenig
2005/0187496 A1 8/2005 Ho
2005/0187601 A1 8/2005 Wang
2006/0213091 A1 9/2006 Ometto et al.
2007/0150004 A1 * 6/2007 Colloca ..... A61H 1/008 606/238
2008/0010851 A1 1/2008 Avanzini
2008/0066343 A1 3/2008 Sanabria-Hernandez
2008/0071202 A1 3/2008 Nardi et al.
2008/0072451 A1 3/2008 Mizrahi
2008/0097268 A1 * 4/2008 Rousso ..... A61H 11/02 602/13
2008/0161734 A1 7/2008 Blockton
2008/0167691 A1 * 7/2008 Weintraub ..... A61H 31/005 607/5
2008/0263899 A1 10/2008 Lee
2009/0030354 A1 1/2009 Ghatge
2009/0069865 A1 3/2009 Lasko et al.
2009/0149899 A1 6/2009 Ahn
2010/0094184 A1 4/2010 Wong et al.
2010/0198118 A1 * 8/2010 Itnati ..... A61H 31/004 601/41
2010/0257752 A1 10/2010 Goldston et al.
2011/0010398 A1 * 1/2011 Gruenwald ..... G06F 17/30569 707/803
2011/0089725 A1 4/2011 Shantha et al.
2011/0166480 A1 7/2011 Mayer
2012/0046694 A1 * 2/2012 Miller ..... A61H 1/008 606/239
2013/0041298 A1 2/2013 Mayer et al.

FOREIGN PATENT DOCUMENTS

CN 2476275 2/2002
CN 1486148 3/2004
CN 2902266 5/2007
EP 1509101 3/2005
JP 2002325819 11/2002
JP 2004-526477 9/2004
JP 2006521879 9/2006
JP 2008114048 5/2008
KR 20-0265394 2/2002
KR 20030059973 7/2003
KR 20070049008 5/2007
KR 20080070175 7/2008
WO 95-10257 4/1995
WO 2005013743 2/2005
WO 2009152544 12/2009
WO WO 2011109725 9/2011

OTHER PUBLICATIONS

Office Action dated Jun. 10, 2016 for Canadian Patent Application No. 2,730,238.
Office Action dated Jun. 27, 2016 for Chinese Patent Application No. 201280068673.X.
Non-Final Office Action dated Jul. 14, 2016 for U.S. Appl. No. 14/178,554.

(56) References Cited

OTHER PUBLICATIONS

Office Action dated Mar. 10, 2016 for Chinese Patent Application No. 201510026309.2.
Office Action dated Mar. 24, 2016 for Korean Patent Application No. 2011-7001073.
Office Action dated Mar. 29, 2016 for Chinese Patent Application No. 201280068673.X.
Notice of Allowance and Examiner's Interview Summary dated May 3, 2016 for U.S. Appl. No. 13/554,834.
Examination Report dated Sep. 8, 2015 for European Patent Application No. 09795105.7.
Non-Final Office Action dated Sep. 10, 2015 for U.S. Appl. No. 13/554,834.
Office Action dated Aug. 25, 2015 for Chinese Patent Application No. 201280068673.X.
Restriction Requirement dated Oct. 7, 2015 for U.S. Appl. No. 14/178,554.
European Search Report dated May 3, 2012 for PCT/US2009049910.
Office Action dated Jun. 9, 2013 in Chinese Patent Application No. 200980132527.7.
Office Action dated Mar. 6, 2014 for patent application in China application No. 200980132527.7.
International Preliminary Report on Patentability dated Feb. 27, 2014 for PCT/US2012/050290.
Office Action dated Aug. 3, 2012 for Mexican Patent Application No. MX/a/2011/000246.
International Preliminary Report on Patentability dated Sep. 20, 2012 for PCT/US2011/027220.
International Search Report dated Oct. 26, 2012 re: PCT/US2012/050290.
International Search Report and Written Opinion for PCT/US12/67365 dated Feb. 15, 2013.
Office Action dated Feb. 12, 2013 for Mexican Patent Application No. MX/a/2011/000246.
Office Action dated Mar. 5, 2013 for European Patent Application No. 09795105.7-1658.
Office Action dated May 15, 2013 for U.S. Appl. No. 13/040,982.
International Search Report dated Nov. 15, 2011 for PCT/U52009/049910.
International Search Report dated Nov. 22, 2011 for PCT/U52011/027220.
Non-Final Office Action dated Sep. 21, 2011 for U.S. Appl. No. 13/004,754.
Office Action dated May 2, 2012 for MX/a/2011/000246.
Office Action dated Feb. 7, 2012 for U.S. Appl. No. 13/004,754.
Notice of Allowance dated Dec. 15, 2010 for U.S. Appl. No. 12/499,473.
Notice of Allowance dated Nov. 29, 2010 for U.S. Appl. No. 12/499,473.
Final Office Action dated Jun. 22, 2010 for U.S. Appl. No. 12/499,473.
Non-Final Office Action dated Apr. 15, 2010 for U.S. Appl. No. 12/499,473.
Patent Examination Report No. 1 dated May 13, 2014 for Australian Patent Application No. 2009268641.
Office Action dated Nov. 1, 2016 for Chinese Patent Application No. 20150026309.2.
Examination Report dated Aug. 19, 2015 for Australian Patent Application No. 2009268641.
European Search Report and Opinion dated Jun. 15, 2015 for European Patent Application No. 12853699.2.
Advisory Action dated Aug. 10, 2015 for U.S. Appl. No. 13/193,446.
Office Action dated Jan. 8, 2016 for Korean Patent Application No. 2011-7001073.
Notice of Allowance dated Dec. 7, 2015 for U.S. Appl. No. 13/193,446.
Non-Final Office Action dated Dec. 22, 2015 for U.S. Appl. No. 14/178,554.
Final Office Action dated Jan. 13, 2016 for U.S. Appl. No. 13/554,834.
Office Action dated Aug. 28, 2015 for Canadian Patent Application No. 2730238.
Examination Report dated Nov. 6, 2015 for Australian Patent Application No. 2009268641.
Office Action dated Jul. 24, 2014 for Chinese Patent Application No. 200980132527.7.
Examination Report dated Aug. 5, 2014 for European Patent Application No. 09795105.7.
Preliminary Report on Patentability dated Jun. 12, 2014 for PCT/US2012/067365.
Australian Patent Examination Report No. 1 dated May 13, 2014 for 2009268641.
Notice of Allowance dated Apr. 12, 2012 for U.S. Appl. No. 13/004,754.
Non-Final Office Action dated Aug. 1, 2014 for U.S. Appl. No. 13/193,446.
Office Action dated Sep. 8, 2012 for Mexican Patent Application No. MX/a/2011/000246.
Final Office Action dated Mar. 12, 2014 for U.S. Appl. No. 13/040,982.
Examination Report dated Feb. 9, 2015 for European Patent Application No. 09795105.7.
Examiner's Interview dated Mar. 20, 2012 for U.S. Appl. No. 13/004,754.
Examination Report dated Mar. 26, 2015 for Australian Patent Application No. 200926641.
Final Office Action dated Mar. 26, 2015 for U.S. Appl. No. 13/193,446.
Notice of Allowance dated Aug. 28, 2013 for Mexican Patent Application No. MX/a/2011/000246.
Restriction Requirement dated May 19, 2015 for U.S. Appl. No. 13/554,834.
International Preliminary Report on Patentability dated Sep. 14, 2017 from PCT Application No. PCT/US2016/019236.
Non-Final Office Action dated Aug. 15, 2017 for U.S. Appl. No. 14/637,143.
Non-Final Office Action dated Apr. 19, 2017 for U.S. Appl. No. 14/362,108.
Office Action dated Apr. 25, 2017 for Chinese Patent Application No. 201510026309.2.
Notice of Allowance and Examiner's Amendment dated May 24, 2017 for U.S. Appl. No. 14/178,554.
U.S. Appl. No. 15/221,708, filed Jul. 28, 2016, Foot Compression System.
U.S. Appl. No. 13/040,982, filed Mar. 4, 2011, Therapy Shoe.
U.S. Appl. No. 14/637,143, filed Mar. 3, 2015, Insole Foot Compression System and Methods.
U.S. Appl. No. 13/554,834, filed Jul. 20, 2012, Foot Compression System.
U.S. Appl. No. 14/178,554, filed Feb. 12, 2014, Foot Compression and Electrical Stimulation System.
U.S. Appl. No. 13/193,446, filed Jul. 28, 2011, Treatment and/or Prevention of Medical Conditions via Compression.
Final Office Action dated Jan. 23, 2017 for U.S. Appl. No. 14/178,554.
Notice of Allowance dated Jan. 2, 2017 for Canadian Patent Application No. 2,730,238.
Interview Summary dated Apr. 7, 2017 for U.S. Appl. No. 14/178,554.

* cited by examiner

SPRING-DRIVEN FOOT COMPRESSION SYSTEM

TECHNICAL HELD

The present disclosure generally relates to medical care, and specifically to systems and methods for compressing a portion of a human body to treat and/or prevent a medical condition.

BACKGROUND

In order to enhance circulation in a person's body, particularly in the feet and legs, periodic or cyclic compression of tissue, such as plexus regions of the foot, at predetermined timed intervals is beneficial. Under normal circumstances, blood moves up the legs due to muscle contraction and general movement of the feet or legs, such as when walking. If a person is immobilized, unable to move regularly, or has poor circulation brought on by disease, the natural blood return mechanism is impaired, and circulatory problems such as ulcers, deep vein thrombi, pulmonary emboli, and/or the like can occur.

To mitigate these problems, it is desirable to concentrate a compression force against veins throughout the legs and/or feet. Current systems are primarily based on pneumatic compression devices that squeeze the entire foot, calf, or thigh. These systems require significant power, and are inefficient because they provide high levels of force across the entire foot or leg rather than focusing in on those areas with the highest concentration of blood vessels. In addition, these systems may include air bags that can rupture at the seam, especially with high pressure within the bag.

In various current devices, tethered air lines limit mobility, and can lead to injury should the person attempt to walk while the device is in use. Further, existing devices may not be suited for continuous usage. Users cannot walk with them, or move away from the compression unit. The device must be removed before a user can walk. Additionally, current devices lack the ability to track and report user usage and compliance. Also, most pneumatic devices are quite noisy and can cause irritation of the skin leading to ulcers.

BRIEF DESCRIPTION OF THE DRAWINGS

The subject matter of the present disclosure is particularly pointed out and distinctly claimed in the concluding portion of the specification. The present disclosure, however, both as to organization and method of operation, may best be understood by reference to the following description taken in conjunction with the claims and the accompanying drawing figures, in which like parts may be referred to by like numerals:

DETAILED DESCRIPTION

Details of the present disclosure may be described herein in terms of various components and processing steps. It should be appreciated that such components and steps may be realized by any number of hardware and/or software components configured to perform the specified functions. For example, a foot compression system may employ various medical treatment devices, input and/or output elements and the like, which may carry out a variety of functions under the control of one or more control systems or other control devices, in addition, details of the present disclosure may be practiced in any number of medical or treatment contexts, and exemplary embodiments relating to afoot compression system, for example usable in connection with treatment of deep vein thrombosis, or in connection with athletic recovery, as described herein are merely a few of the exemplary applications. For example, the principles, features and methods discussed may be applied to any medical or other tissue or treatment application.

Further, the principles of the present disclosure are described herein with continued reference to a foot for purposes of explanation. However, such principles may also be applied to other parts of a body, for example when improvement of circulation is desired.

Figure 1:
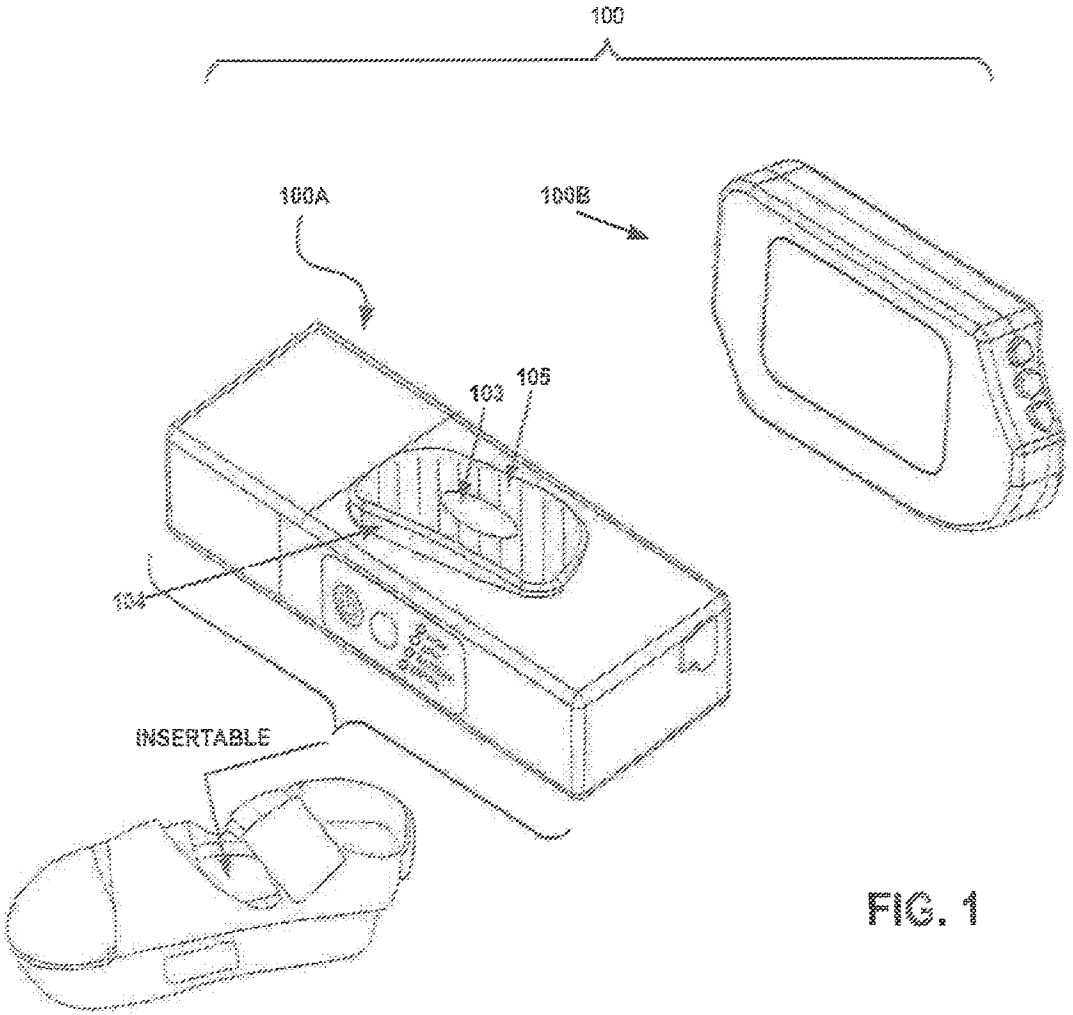
FIG. 1 illustrates a foot compression system in accordance with an exemplary embodiment.

A foot compression system may be any system configured to deliver a compressive force to a portion of a living organism, for example a human foot or leg. With reference now to FIG. 1, and in accordance with an exemplary embodiment, a foot compression system 100 comprises a tissue depressor 100A. In various exemplary embodiments, foot compression system 100 also comprises reader portion 100B. Tissue depressor 100A is configured to deliver a reciprocating compressive force to a portion of a living organism, for example a human foot. The reciprocating compressive force may be delivered responsive to communication with reader portion 100B. Moreover, a foot compression system may be configured with any appropriate components and/or elements configured to deliver a reciprocating compressive force to a portion of a living organism.

In an exemplary embodiment, tissue depressor 100A may be responsive to communication with one or more of a reader portion 120, a computer, or an external input. With further reference now to FIGS. 2A-2B, 3, and 4A-4C, and in accordance with an exemplary embodiment, tissue depressor 100A comprises depressor housing 102, pressure pad 104, pad top 105, motor 106, gearbox 108, output gears 110, main gears 112, slip clutch 116, control electronics 118, and weight sensor 120. Reader portion 100B comprises control box 130, batteries 132 (not shown in figures), display 134, and inputs 136. In an exemplary embodiment not comprising a reader portion, tissue depressor 100A may further comprise various external inputs. In various other exemplary embodiments, certain components are not present, for example slip clutch 118 and reader portion 100B.

Tissue depressor 100A may be any device, system, or structure configured to apply a compressive force to a foot. In an exemplary embodiment, tissue depressor 100A is configured to be removably located in the sole area of an item of footwear such as a shoe, sandal, or any other type of footwear product. In other exemplary embodiments, tissue depressor 100A may be integrated into an item of footwear. Tissue depressor 100A may also be a stand-alone unit, for example a footrest.

As used herein, a "shoe" may be understood to be a fitted protective covering for a human foot which is typically worn when walking and is intended to be worn while walking to enable ease in walking and to protect the wearer's foot. Exemplary types of shoes include but are not limited to athletic shoes (e.g. sneakers, running shoes, gym shoes, etc.), dress shoes (e.g., oxfords, monks, derbys, loafers, etc.), and sandals. Typically, a shoe does not extend above the ankle; a shoe-like item of footwear with an upper that extends above the ankle may be referred to herein as a "boot" In certain exemplary embodiments, a shoe may be a specialized shoe worn for medical treatment that enables a wearer to easily walk while wearing the shoe in between treatments. In yet other exemplary embodiments, a shoe will be a specially outfitted athletic shoe that is visibly indistinguishable from a traditional athletic shoe.

In various exemplary embodiments, tissue depressor 100A has an outer shape at least partially defined by a main housing 102. Main housing 102 may be formed of metal, plastic, composite, or other suitable durable material. Main housing 102 is configured to enclose various portions of foot compression system 100. Tissue depressor 100A may be configured to be entirely contained within and/or integrated into an item of footwear, for example a shoe.

Figure 2A:
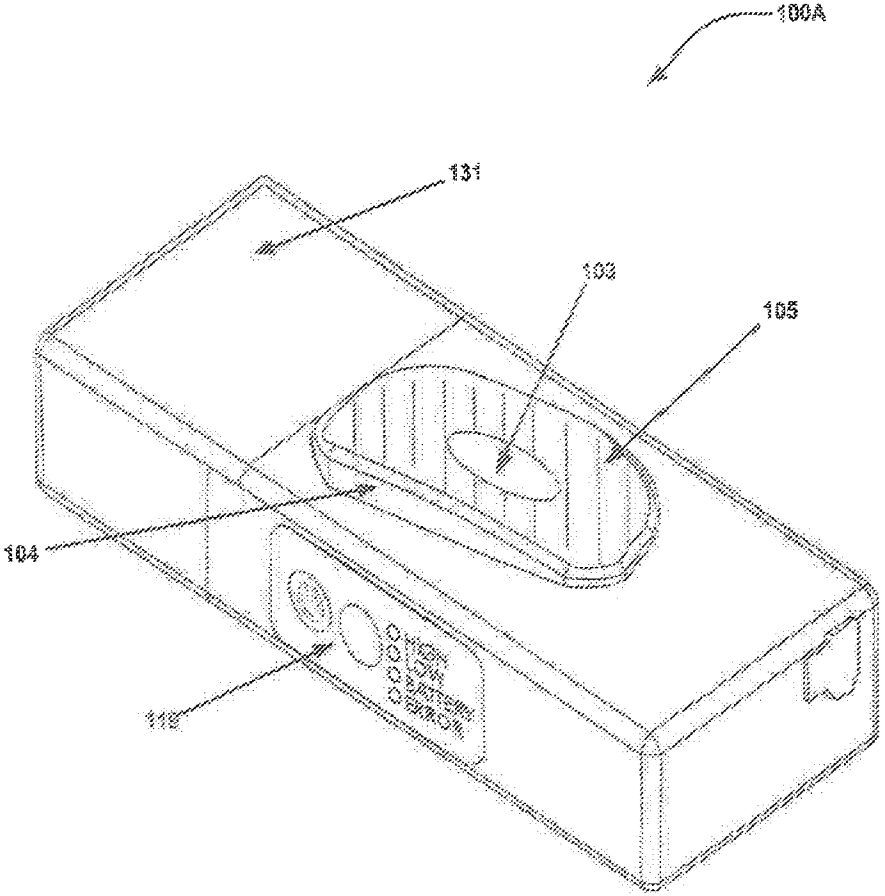
FIG. 2A illustrates an tissue depressor of a foot compression system in accordance with an exemplary embodiment.
Figure 2B:
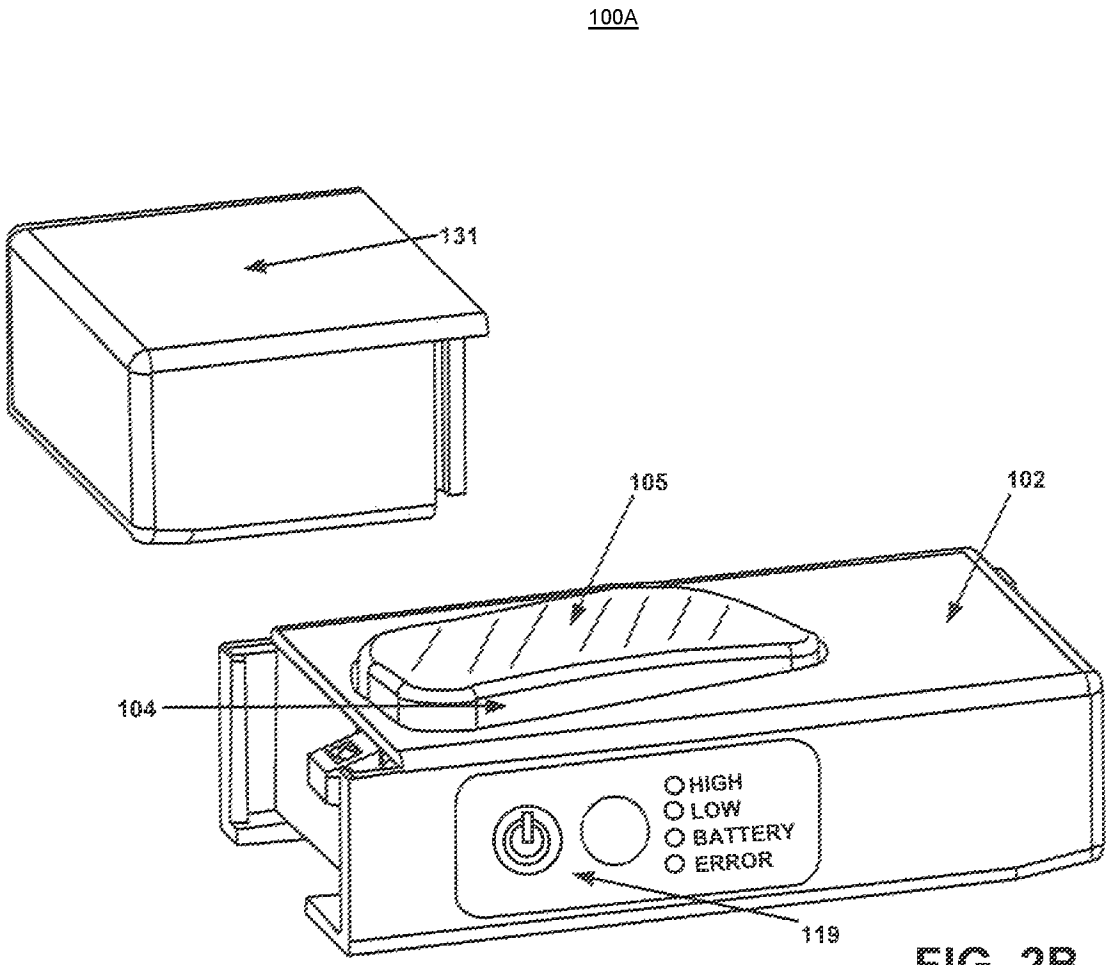
FIG. 2B illustrates an tissue depressor of a foot compression system with a battery detached in accordance with an exemplary embodiment.
Figure 3:
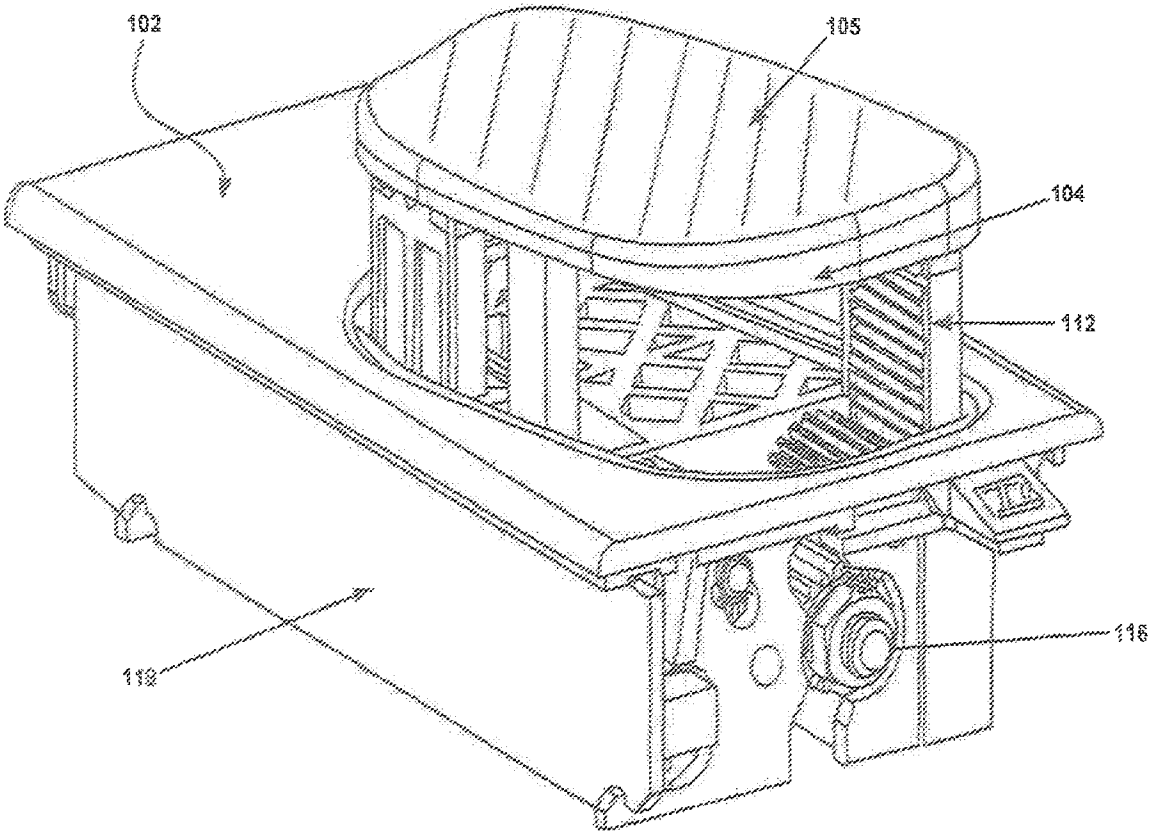
FIG. 3 illustrates various components of an tissue depressor of a foot compression system in accordance with an exemplary embodiment.

Turning now to FIGS. 2A through 3, and in accordance with an exemplary embodiment, pressure pad 104 comprises a rigid or semi-rigid structure configured to press against a person's foot, in various exemplary embodiments, pressure pad 104 is extendable and retractable. Moreover, pressure pad 104 may be rigid, semi-rigid, non-deformable, and/or non-bendable. Pressure pad 104 is coupled to main gears 112. Moreover, pressure pad 104 may be configured to be moved by and/or coupled to any suitable power transfer components.

Pressure pad 104 may be made of any suitable materials, for example metal, plastic, composite, and/or the like. Moreover, pressure pad 104 may be comprised of any material suitable for transferring force to a person's foot. Pressure pad 104 may be monolithic. Alternatively, pressure pad 104 may comprise two or more individual components. In certain exemplary embodiments, pressure pad 104 comprises a rigid main structure configured with a flexible pad top 105, for example a pad top 105 comprised of rubber, silicone, or other suitable material. Pad top 105 may be smooth, ridged, dimpled, patterned, and/or otherwise shaped and/or textured. In this manner, pressure pad 104 may be configured to press against a person's foot while providing a desired level of cushioning, comfort, friction, and/or the like, for example due to pad top 105.

Pressure pad 104 can be any size to transfer a desired amount of force to a person's foot. According to an exemplary embodiment, pressure pad 104 applies force directly to the arch region of the foot. In various exemplary embodiments, pressure pad 104 comprises a contact surface area in the range of about 6 square centimeters to about 30 square centimeters. In various exemplary embodiments, pressure pad 104 comprises a contact surface area in the range of about 10 square centimeters to about 24 square centimeters. In other exemplary embodiments, pressure pad 104 comprises a contact surface area in the range of about 18 square centimeters to about 23 square centimeters. However, pressure pad 104 may be configured with any appropriate dimensions, surfaces, angles, and/or components, as desired, in order to transfer force to a foot. For example, in certain exemplary embodiments wherein foot compression system 100 is utilized in connection with athletic recovery, pressure pad 104 may be configured with a contact surface area substantially equal to the surface area of the bottom of a foot, for example a contact surface area in the range of between about 100 square centimeters to about 150 square centimeters. In various other exemplary embodiments wherein foot compression system 100 is utilized in connection with treatment of plantar fasciitis, treatment of deep vein thrombosis, treatment of restless leg syndrome, and/or wound care, pressure pad 104 may be configured with a contact area in the range of about 6 square centimeters to about 150 square centimeters, as desired.

In various exemplary embodiments, pressure pad 104 further comprises a pressure sensor 103 configured to measure the pressure generated by pressure pad 104. The pressure sensor may communicate with control electronics 118 and/or other components of foot compression system 100 in order to achieve a desired level of pressure generated by pressure pad 104.

In an exemplary embodiment, pressure pad 104 may be kept in an extended position for a time between about 1 second and about 5 seconds. In various exemplary embodiments, pressure pad 104 is pressed against the venous plexus region of the foot for a time between about 1 second and about 5 seconds, and preferably about 2 seconds. When extended away from main housing 102, pressure pad 104 presses against the venous plexus region of the foot. Pressure pad 104 compresses the veins both in the arch of the foot and across the top of the foot from approximately the metatarsal-phalangeal joints to the talus. In various exemplary embodiments, pressure pad 104 is pressed against the venous plexus region of the foot for a time between approximately 1 and 5 seconds. In another exemplary embodiment, pressure pad 104 is pressed against the venous plexus region of the foot for approximately 2 seconds. However, principles of the present disclosure contemplate pressure pad 104 pressing against any desired site on a body and being kept in an extended position for any suitable time, for example to stimulate blood flow.

In an exemplary embodiment, pressure pad 104 is configured to extend and/or retract over a desired time period. In various exemplary embodiments, pressure pad 104 is configured to extend from a fully retracted position to a fully extended position in a time between about 0.1 seconds and about 1 second, and preferably between about 0.1 seconds and about 0.3 seconds. However, pressure pad 104 may be configured to extend and/or retract over any suitable time period. Moreover, variances in between individuals (e.g., the unique features of a foot such as height of arch, curvature of arch, width, length, and/or the like) may effect the time period over which pressure pad 104 is deployed.

In an exemplary embodiment, pressure pad 104 retracts so that it is flush or nearly flush with an outer surface of main housing 102. Compression and relaxation is then followed by a period of non-compression to allow the veins to re-fill with blood. In various exemplary embodiments, pressure pad 104 is pressed against the venous plexus region of the foot and then retracted in regular intervals of between about 20 seconds to about 45 seconds, and preferably between about 25 seconds and about 35 seconds, in another exemplary embodiment, pressure pad 104 is pressed against the venous plexus region of the foot and then retracted in regular intervals of about 30 seconds. However, pressure pad 104 may be pressed against the venous plexus region of the foot and then retracted in any suitable interval, for example to stimulate blood flow. For example, compression may be rapid in order to move blood through the veins of the lower leg at an elevated velocity and to release chemical compounds that reduce pain.

In various exemplary embodiments, switches may be employed to ensure that pressure pad 104 does not extend beyond a pressure threshold, such as between about 1 mmHg and 500 mmHg, and more preferably between about 300 mmHg and about 465 mmHg. In various exemplary embodiments, pressure pad 104 is extended with a three of between about 50 Newtons and about 115 Newtons, and more preferably between about 60 Newtons and about 100 Newtons. While various pressures and/or forces have been described herein, other pressures and/or forces can be applied and fall within the scope of the present disclosure. Moreover, switches and/or other devices may be placed at the locations of maximum and/or minimum extension of pressure pad 104 in order to ensure that motor 106 is appropriately shut off at the end of travel.

While specific time ranges, sizes, pressures, movement distances, and the like have been described herein, these values are given purely for example. Various other time ranges, sizes, pressures, distances, and the like can be used and fall within the scope of the present disclosure. Any device configured to apply pressure to a person's foot as set forth herein is considered to fall within the scope of the present disclosure.

In accordance with an exemplary embodiment, switches and/or other appropriate mechanisms may be located at the maximum and/or minimum extensions of pressure pad 104 in order to prevent motor 106 from attempting to force pressure pad 104 beyond the end of travel. Such switches or other travel-limiting devices may be implemented mechanically, in hardware, in software, or any combination of the foregoing.

Figure 4A:
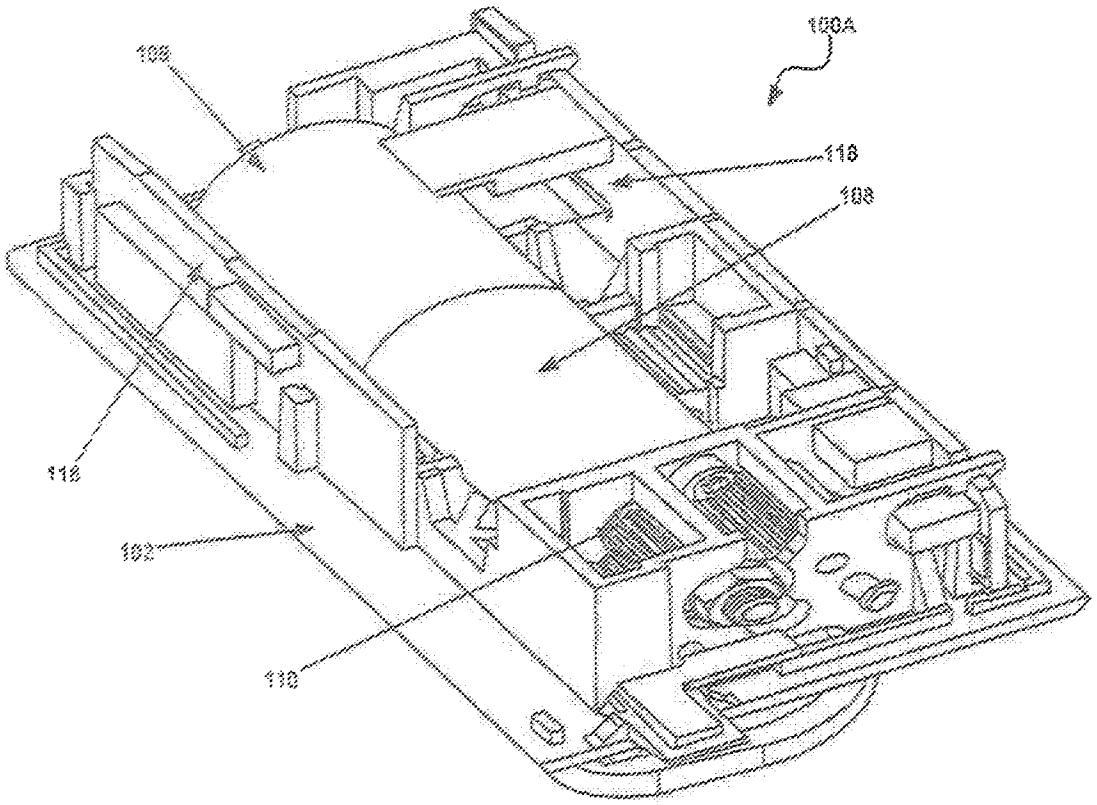
FIGS. 4A through 4C illustrate various components of an tissue depressor of a foot compression system in accordance with an exemplary embodiment.
Figure 4B:
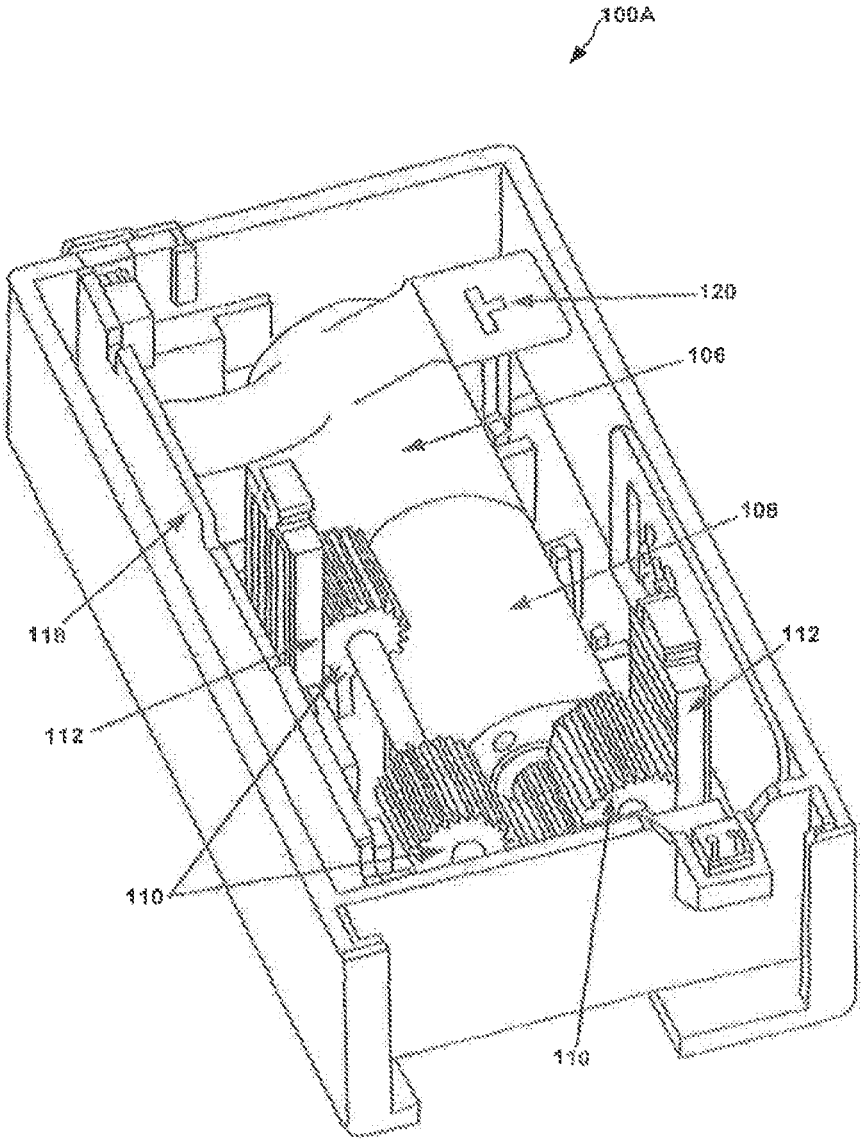
Figure 4C:
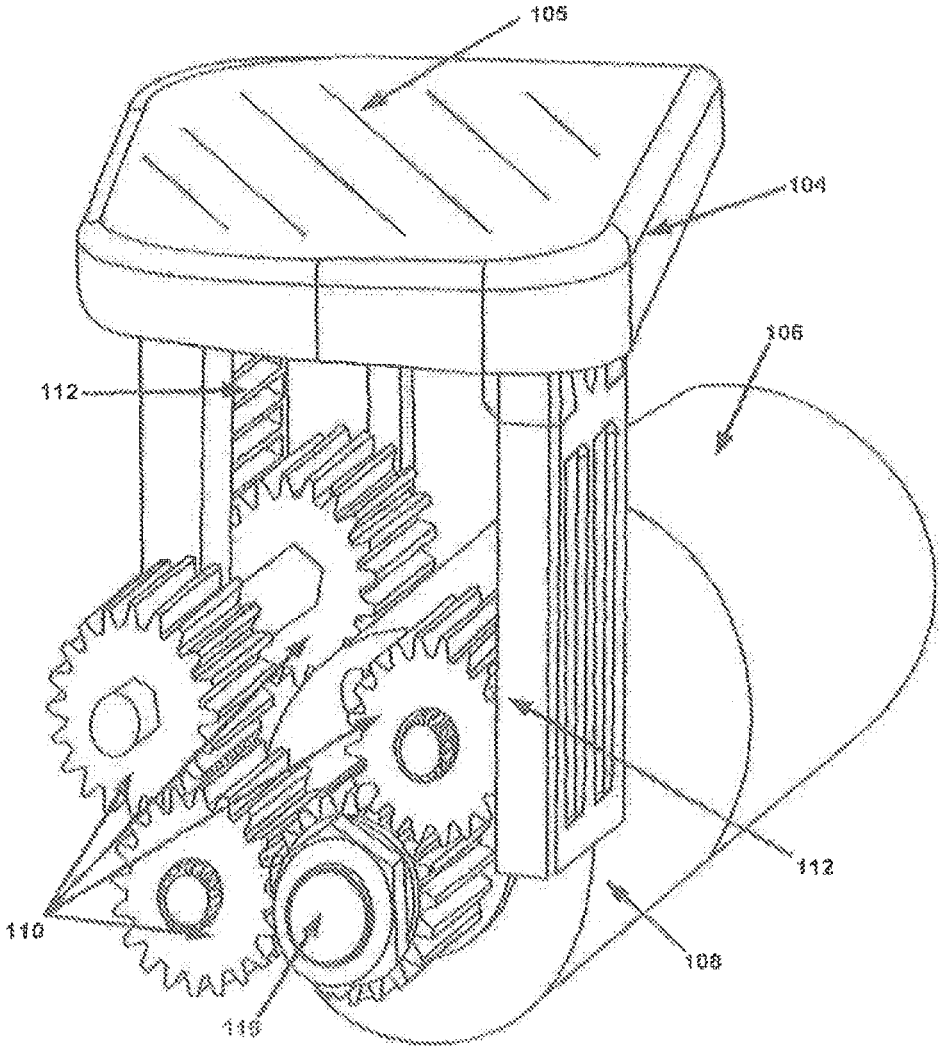

Motor 106 may be any component configured to generate mechanical force to move pressure pad 104. With reference now to FIGS. 4A through 4C, and in accordance with an exemplary embodiment, motor 106 comprises a rotary output shaft driving a pinion. Motor 106 may comprise any suitable motor, such as a brushless direct current (DC) motor, a brushed DC motor, a coreless DC motor, a linear DC motor, and/or the like. Moreover, any motor, actuator, micro-engine, or similar device presently known or adopted in the future to drive moving parts within foot compression system 100 falls within the scope of the present disclosure. In various other exemplary embodiments, motor 106 may be replaced with another suitable power generation mechanism capable of moving pressure pad 104, such as an artificial muscle, a piezoelectric material, a shape memory alloy, and/or the like. In various exemplary embodiments, motor 106 is coupled to gearbox 108.

With continued reference to FIGS. 4A through 4C, and in accordance with an exemplary embodiment, gearbox 108 comprises a mechanism configured to increase the mechanical advantage obtained by motor 106, for example a reduction gearbox. Gearbox 108 is coupled to motor 106 and to output gears 110. Output three from motor 106 is transferred through gearbox 108 in order to achieve an appropriate gear ratio for effectuating movement of pressure pad 104. Thus, gearbox 108 may have a fixed gear ratio. Alternatively, gearbox 108 may have a variable or adjustable gear ratio. Gearbox 108 may comprise any suitable ratio configured in any suitable matter to effectuate movement of pressure pad 104. Moreover, gearbox 108 may comprise any suitable components, configurations, ratios, mechanisms, and/or the like, as desired, in order to transfer output force from motor 106 to other components of foot compression system 100, for example output gears 110.

Output gears 110 may comprise any mechanism configured to transfer force from gearbox 108 to main gears 112. Continuing to reference FIGS. 4A through 4C, in accordance with an exemplary embodiment, output gears 110 comprise metal, plastic, or other durable material. Output gears 110 are coupled to gearbox 108 and to main gears 112. Output force from motor 106 is transferred through gearbox 108 to output gears 110. Output gears 110 are further configured to interface with main gears 112. Moreover, output gears 110 may comprise any composition or configuration suitable to transfer force to main gear 112.

Main gears 112 may comprise any suitable component or structure configured to effectuate movement of pressure pad 104. As illustrated in FIGS. 4A through 4C, in an exemplary embodiment, one or more main gears 112 are coupled to pressure pad 104. Main gears 112 interface with output gear 110. As main gears 112 move in response to three transferred by output gears 110, pressure pad 104 is extended and/or retracted through its range of motion. In various exemplary embodiments, main gears 112 are configured to effectuate movement of pressure pad 104 a distance of between about 1 mm to about 24 mm from a fully retracted to a fully extended position. In various other exemplary embodiments, main gears 112 are configured to effectuate movement of pressure pad 104 a distance of between about 12 min to about 24 mm from a fully retracted to a fully extended position. Moreover, movement of pressure pad 104 may vary based on an individual user. For example, pressure pad 104 may be extended a larger distance for a user having a higher foot arch, and a smaller distance for a user having a lower foot arch. Additionally, pressure pad 104 may be moved between a fully retracted and a partially extended position, for example if a desired pressure value is reached via partial extension of pressure pad 104. Pressure pad 104 may also move responsive to operation of slip clutch 116.

With reference to FIGS. 4A through 4C, slip clutch 116 may comprise any mechanism configured to prevent damage to motor 106 and/or injury to a person. For example, if a person applies excessive force or weight to their foot when pressure pad 104 is extended, slip clutch 116 allows pressure pad 104 to safely retract back towards main housing 102. In an exemplary embodiment, slip clutch 116 is a friction clutch. Slip clutch 116 is configured to slip when excessive force is placed on pressure pad 104. In various exemplary embodiments, slip clutch 116 is configured to slip when the force on pressure pad 104 exceeds between about 130 Newtons to about 200 Newtons. In another exemplary embodiment, slip clutch 116 is configured to slip when the force on pressure pad 104 exceeds 155 Newtons. Moreover, slip clutch 116 may be configured to slip responsive to any suitable three in order to prevent damage to motor 106 or other components of foot compression system 100 and/or injury to a person.

In various exemplary embodiments, foot compression system 100 may be at least partially operated, controlled, and/or activated by one or more electronic circuits, for example control electronics 118. In accordance with an exemplary embodiment, control electronics 118 and/or an associated software subsystem comprise components configured to at least partially control operation of foot compression system 100. For example, control electronics 118 may comprise integrated circuits, discrete electrical components, printed circuit boards, and/or the like, and/or combinations of the same. Control electronics 118 may further comprise clocks or other timing circuitry. Control electronics 118 may also comprise data logging circuitry, for example volatile or non-volatile memories and the like, to store data, such as data regarding operation and functioning of foot compression system 100. Moreover, a software subsystem may be pre-programmed and communicate with control electronics 118 in order to adjust various variables, for example the time that pressure pad 104 remains in an extended position, the pressure applied to the foot, intervals of travel between the extended and retracted positions of pressure pad 104, the time it takes for pressure pad 104 to extend to the extended position and retract to a recessed position, and/or the like.

Control electronics 118 may be configured to store data related to foot compression system 100. For example, in various exemplary embodiments, control electronics 118 may record if foot compression system 100 is mounted to the foot of a person and active, if foot compression system 100 is mounted to the foot of a person and inactive, if foot compression system 100 is not mounted to the foot of a person and system 100 is inactive, and/or the like and/or combinations of the same. Further, control electronics 118 may record the duration foot compression system 100 is active, the number of compression cycles performed, one or more pressures generated by foot compression system 100, and so forth. Moreover, control electronics 118 may further comprise circuitry configured to enable data stored in control electronics 118 to be retrieved for analysis, deleted, compacted, encrypted, and/or the like.

In accordance with an exemplary embodiment, when pressure pad 104 is being extended or is in a fully extended state, control electronics 118 may monitor the pressure applied by pressure pad 104. For example, control electronics 118 may monitor the current drawn by motor 106 and calculate the applied pressure. Alternatively, a pressure sensor may detect the applied pressure and report this value to control electronics 118 and/or an associated software subsystem.

In various exemplary embodiments, pressure pad 104 may be extended until a pressure threshold, such as between about 1 mmHg and 500 mmHg, is reached. In other exemplary embodiments, pressure pad 104 may be extended until a pressure threshold of between about 300 mmHg and 465 mmHg is reached. Alternatively, pressure pad 104 may be extended until pressure pad 104 is at the point of maximum extension from main housing 102. In various exemplary embodiments, pressure pad 104 is extended with a force of between approximately 50 Newtons and approximately 115 Newtons. In other exemplary embodiments, pressure pad 104 is extended with a force of between approximately 75 Newtons and approximately 100 Newtons. While various pressures and/or forces have been described herein, other pressures and/or forces can be applied and fall within the scope of the present disclosure. Moreover, switches and/or other devices may be placed at the locations of maximum and/or minimum extension of pressure pad 104 in order to ensure that motor 106 is appropriately shut off at the end of travel.

With reference to FIG. 4B, in accordance with an exemplary embodiment, weight sensor 120 is provided within main housing 102. Weight sensor 120 comprises any suitable sensor configured to detect weight applied to main housing 102. When weight sensor 120 detects a suitable amount of weight, such as 25 pounds or more, electronic controls 118 may infer that the person is walking or otherwise putting pressure on tissue depressor 100A. Moreover, any appropriate weight may be utilized, and thus falls within the scope of the present disclosure. Accordingly, electronic controls 118 may implement a delay in activating foot compression system 100 to ensure the person does not walk on the raised pressure pad 104.

In various exemplary embodiments, tissue depressor 100A may comprise various sensors, for example pressure sensors, weight sensors, strain gauges, accelerometers, and/or the like. Tissue depressor 100A and/or reader portion 100B may utilize one or more sensors for monitoring and/or control of foot compression system 100. For example, in certain exemplary embodiments it may be desirable to prevent extension of pressure pad 104 when a person is walking or applying body weight to tissue depressor 100A. Thus, electronic control 118 may prevent extension of pressure pad 104 and/or retract pressure pad 104, for example responsive to sensor input indicating a person is walking (e.g., accelerometer readings, weight sensor readings, and/or the like). In various exemplary embodiments, foot compression system 100 may be configured to be turned "on" when a user is seated and/or recumbent, and configured to be turned to a "standby" mode (e.g., a mode wherein pressure pad 104 remains retracted) when a user is standing and/or walking.

With reference now to FIGS. 2A and 2B, in an exemplary embodiment, tissue depressor 100A may further comprise one or more indicators 119. Indicators 119 may comprise any components configured to receive input from a user and/or to deliver feedback to a user. For example, indicators 119 may comprise on/off buttons, lights, switches, and/or the like. In an exemplary embodiment, indicators 119 comprise a power button, a "high" foot compression setting light, a "low" foot compression setting light, a battery level warning light, and an error message light. Moreover, indicators 119 may comprise any suitable input and/or output components, as desired.

With reference to FIG. 4B, in an exemplary embodiment, foot compression system 100 is configured with weight sensor 120. Weight sensor 120 comprises any suitable sensor configured to detect weight applied to depressor housing 102. When weight sensor 120 detects a suitable amount of weight, for example 25 pounds or more, control electronics 118 may infer that a person is walking or otherwise putting pressure on tissue depressor 100A. Accordingly, control electronics 118 may implement a delay in activating tissue depressor 100A to ensure pressure pad 104 us not extended. Moreover, any appropriate weight may be utilized, and thus falls within the scope of the present disclosure.

With continued reference to FIGS. 2A and 2B, in accordance with an exemplary embodiment, tissue depressor 100A further comprises a removable battery 131. Battery 131 may comprise electrochemical cells suitable to provide power for tissue depressor 100A. Battery 131 may be rechargeable, but may also be single-use. Batteries 131 may comprise alkaline, nickel-metal hydride, lithium-ion, lithium-polymer, and/or other battery configurations suitable for powering tissue depressor 100A. Moreover, battery 131 may comprise any suitable chemistry, form factor, voltage, and/or capacity suitable to provide power to tissue depressor 100A. As illustrated, battery 131 may be decoupled from main body 102, for example to facilitate recharging of battery 131, as desired.

In various exemplary embodiments, foot compression system 100 may further comprise various sensors, for example motion sensors, pressure sensors, accelerometers, strain gauges, and/or similar components, for example configured to detect movement of foot compression system 100. Control electronics 118 may prevent operation of tissue depressor 100A unless the motion sensor reports tissue depressor 100A (and thus, typically, the limb to which tissue depressor 100A is mounted) has been substantially motionless for a period of time, such as between about 2 minutes and 10 minutes. Further, any appropriate time range is considered to fall within the scope of the present disclosure, as the ranges set forth herein are exemplary only.

In various exemplary embodiments, foot compression system 100 may be configured to be turned "on" when a user is seated and/or recumbent, and configured to be turned to a "standby" mode when a user is standing and/or walking. In an exemplary embodiment, control electronics 118 may prevent operation of foot compression system 100 unless a sensor reports to control electronics 118 that the person utilizing foot compression system 100 has been seated or otherwise stationary or recumbent for a suitable period of time, e.g. between 2 and 10 minutes.

Figure 5:
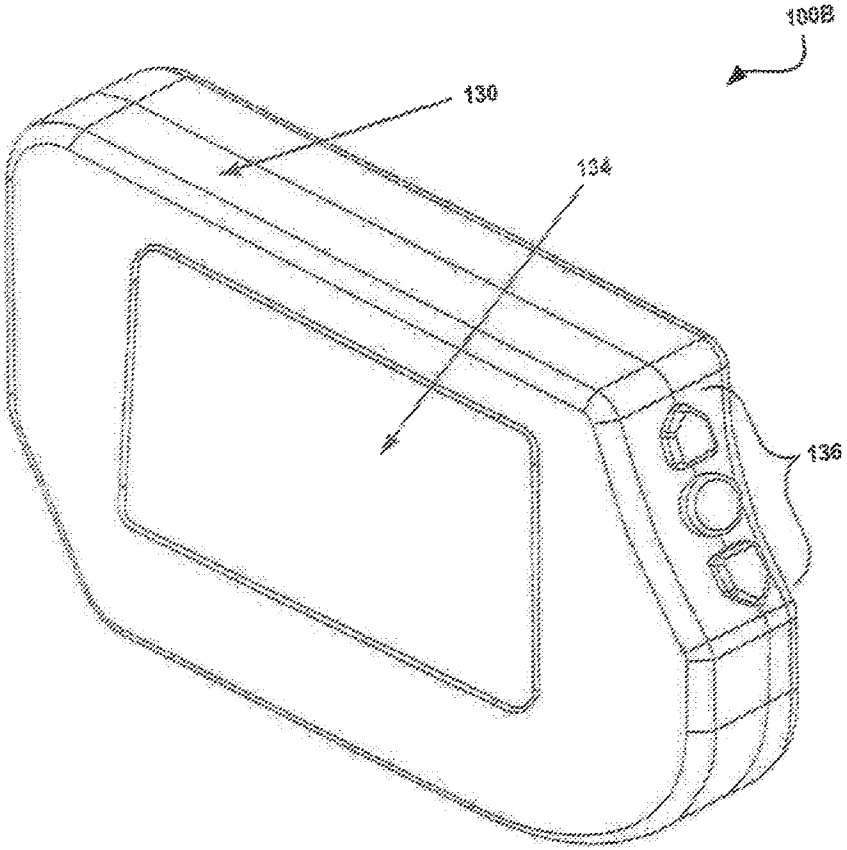
FIG. 5 illustrates a reader portion of a foot compression system in accordance with an exemplary embodiment.

With reference now to FIGS. 1 and 5, and in accordance with an exemplary embodiment, foot compression system 100 may comprise a reader portion 100B configured to facilitate communication with and/or control of tissue depressor 100A and/or other components of foot compression system 100. Reader portion 100B may comprise any suitable components, circuitry, displays, indicators, and/or the like, as desired.

For example, in an exemplary embodiment, reader portion 100B is used to control and program foot compression system 100. Reader portion 100B may be configured with a control box 130 comprising metal, plastic, composite, or other durable material suitable to contain various components of reader portion 100B. In an exemplary embodiment, reader portion 100B is coupled to tissue depressor 100A via a cable, for example an electrical cable suitable to carry current to drive motor 106, carry digital signals, carry analog signals, and/or the like. In other exemplary embodiments, reader portion 100B and tissue depressor 100A communicate wirelessly, for example via a suitable communication protocol (e.g., IEEE 802.15.4; Bluetooth™; IEEE 802.11, IEEE 1451, ISA 100.11a; and/or the like). In these embodiments, reader portion 100B and tissue depressor 100A may further comprise transceivers, receivers, transmitters and/or similar wireless technology.

In accordance with an exemplary embodiment, reader portion 100B may comprise one or more batteries 132 (not shown in figures). Batteries 132 may comprise electrochemical cells suitable to provide power for reader portion 100B. Batteries 132 may be rechargeable, but may also be single-use. Batteries 132 may comprise alkaline, nickel-metal hydride, lithium-ion, lithium-polymer, or other battery configurations suitable for powering reader portion 100B. Moreover, batteries 132 may comprise any suitable chemistry, form factor, voltage, and/or capacity suitable to provide power to reader portion 100B.

Batteries 132 may be recharged via an external charger. Batteries 132 may also be recharged by use of electronic components within reader portion 100B. Alternatively, batteries 132 may be removed from reader portion 100B and replaced with fresh batteries.

With reference now to FIG. 5, and in accordance with an exemplary embodiment, reader portion 100*b* further comprises a display 134 configured for presenting information to a user. In an exemplary embodiment, display 134 comprises a liquid crystal display (LCD). In other exemplary embodiments, display 134 comprises light emitting diodes (LEDs). In still other exemplary embodiments, display 134 comprises visual and audio communication devices such as speakers, alarms, and/or other similar monitoring and/or feedback components. Moreover, display 134 may also comprise audible or tactile feedback components. Display 134 is configured to provide feedback to a system user. Moreover, display 134 may comprise any suitable components configured to provide information to a system user.

With continued reference to FIG. 5, inputs 136 may comprise any components configured to allow a user to control operation of foot compression system 100. In an exemplary embodiment, inputs 136 allow a user to turn foot compression system 100 on and off. Inputs 136 may also allow a user to adjust operating parameters of foot compression system 100, for example the interval of extension of pressure pad 104, the force with which pressure pad 104 is extended, the maximum pressure applied by pressure pad 104, various time intervals to have pressure pad 104 in an extended or retracted position, and/or the like. Further, inputs 136 may allow retrieval of data, such as system usage records. Data may be stored in tissue depressor 100A, for example in control electronics 118, as well as in reader portion 100B, as desired.

In an exemplary embodiment, inputs 136 comprise electronic buttons, switches, or similar devices. In other exemplary embodiments, inputs 136 comprise a communications port, for example a Universal Serial Bus (USB) port. Further, inputs 136 may comprise variable pressure control switches with corresponding indicator lights. Inputs 136 may also comprise variable speed control switches with corresponding indicator lights, on/off switches, pressure switches, click wheels, trackballs, d-pads, and/or the like. Moreover, inputs 136 may comprise any suitable components configured to allow a user to control operation of foot compression system 100.

In accordance with an exemplary embodiment, foot compression system 100 is configured to be inserted into normal, off-the-shelf shoes, sandals, and other footwear. In various exemplary embodiments, pressure pad 104 is moved from the fully retracted position to the fully extended position in a time between about one-tenth (0.1) second and 1 second. In other exemplary embodiments, pressure pad 104 moves from the fully retracted position to the fully extended position in a time between about one-tenth (0.1) seconds and about three-tenths (0.3) seconds. Moreover, variances in individual feet (e.g., height of arch, curvature of arch, width, length, and/or the like) may effect the time period over which pressure pad is deployed.

In accordance with an exemplary embodiment, when moved to the fully extended position, pressure pad 104 may generate a pressure between about 1 mmHg and 500 mmHg against the person's foot. Further, pressure pad 104 may be extended with a force between about 50 Newtons and 115 Newtons in certain exemplary embodiments. Pressure pad 104 may be kept in an extended position for a time between about 1 and 3 seconds. Pressure pad 104 is then retracted. Pressure pad 104 may then be re-extended, such as after a delay of between about 20 and 45 seconds. However, other time frames can be used, and all time frames are thought to fall within the scope of the present disclosure.

While specific time ranges, sizes, pressures, movement distances, and the like have been described herein, these values are given purely for example. Various other time ranges, sizes, pressures, distances, and the like can be used and fall within the scope of the present disclosure. Any device configured to apply pressure to a person's foot as set forth herein is considered to fall within the scope of the present disclosure.

In certain exemplary embodiments, foot compression system 100 is configured for use in, complementary to, and/or as a substitute for low-intensity physical exertion after a workout. Stated another way, foot compression system 100 is configured to facilitate "athletic recovery," or the augmentation of blood flow in the body's venous system to deliver nutrients to the muscles while simultaneously removing lactic acid and metabolic waste. After a workout, it has been found that a person may recover more quickly from the after-effects of exercise (for example, accumulation of lactates in the muscle and/or blood) via low-intensity physical exertion rather than via complete rest. The increased blood circulation attendant to low-intensity physical exertion facilitates the removal of cellular metabolic waste and lactic acid from muscle and the reduction of lactate levels in the bloodstream. Additionally, physical exertion can facilitate facilitating opening the capillary bed to enable remedial hydration and/or efficient nutrient transfer. In contrast, post-workout periods of immobility, for example either sitting or recumbent, do little physiologically to promote athletic recovery. Lowered venous peak velocity and reduced circulation closes the capillaries and locks lactic acid in place, which influences swelling and muscle soreness. Moreover, sitting with hips and knees in flexion, with bends of 60 to 90 degrees in the knees and hips, can kink the arterial blood supply and venous return, elevating the risk of edema stasis, toxin storage, and nutrient deficiency.

Therefore, by promoting blood circulation, foot compression system 100 may be utilized to achieve similar benefits as those obtained via low-intensity physical exertion. For example, foot compression system 100 may be utilized to achieve augmentation of peak venous velocity, augmentation of venous volume return, and/or augmentation of fibrinolysis. Additionally, the increased venous outflow evacuates cellular metabolic waste products and reduces excess fluid trapped in the soft tissues of the lower leg, thereby promoting arterial inflow to the vacated capillary bed. Lower leg edema and other significant risk factors are reduced and/or eliminated. Stated another way, via use of foot compression system 100, a person may achieve similar results as those achieved via low aerobic activity (such as walking) but without actually walking. The user achieves augmented venous outflow despite being in a seated and/or recumbent position.

In an exemplary embodiment, foot compression system 100 may be used by a person as part of a "cool down" process during the "golden hour" approximately the first 60 minutes immediately after a workout. In other exemplary embodiments, foot compression system 100 may be used during a predetermined period after a workout, for example between immediately after a workout to about 12 hours after a workout. Foot compression system 100 may be utilized after a workout for a suitable duration, for example a duration of between about 10 minutes to about 2 hours, in order to assist in athletic recovery. While residual cellular metabolic waste can take several days to flush from the soft tissues, this process can be greatly accelerated via use of foot compression system 100 after a workout. To facilitate use of foot compression system 100 as part of an athletic recovery program, foot compression system 100 or components thereof may be integrated into athletic footwear intended for use during a workout. Moreover, foot compression system 100 or components thereof may also be integrated into specialized post-exercise footwear.

Moreover, foot compression system 100 may be utilized on a regular schedule by a person, for example as part of a pre-workout warmup, a post-workout cooldown, and/or on days when no workout is scheduled. By increasing blood flow, foot compression system 100 can facilitate improved muscle readiness prior to exercise, quicker post-exercise recovery, and/or improved circulation on days absent strenuous exercise. In particular, foot compression system 100 may be desirably utilized by athletes subsequent to athletic events in order to facilitate faster recovery.

In various exemplary embodiments, foot compression system 100 is configured for use in connection with treatment of and/or prevention of one or more medical conditions, for example plantar fasciitis, edema, deep vein thrombosis, pulmonary embolism, restless leg syndrome, venous insufficiency, and/or the like. Moreover, foot compression system 100 may be configured for use in connection with wound care.

In various exemplary embodiments, tissue depressor 100A is entirely contained within an item of footwear, for example a shoe. In one exemplary embodiment, tissue depressor 100A is configured to repeatedly compress the venous plexus region of the foot as discussed herein. In this embodiment, tissue depressor 100A may be utilized for extended post-workout athletic recovery.

In another exemplary embodiment, tissue depressor 100A is configured to compress the venous plexus region of the foot only when the wearer of the footwear is not walking or applying weight to the footwear. In this embodiment, tissue depressor 100A may be utilized for pre-workout warmup, post-workout cooldown, and/or the like, without the need for a change of footwear.

Figure 6A:
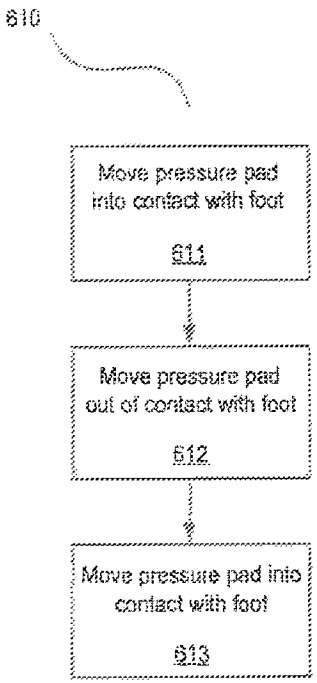
FIGS. 6A, 6B, and 6C illustrate methods of using a foot compression system in accordance with various exemplary embodiments.
Figure 6B:
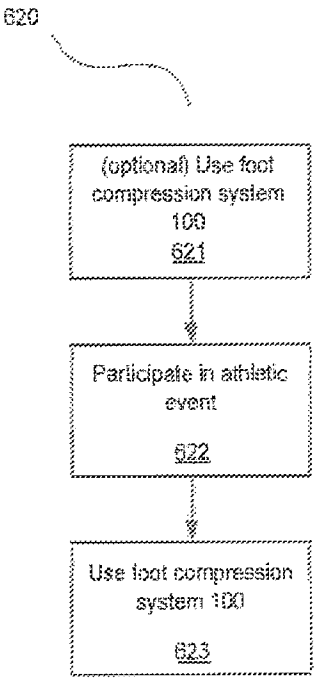
Figure 6C:
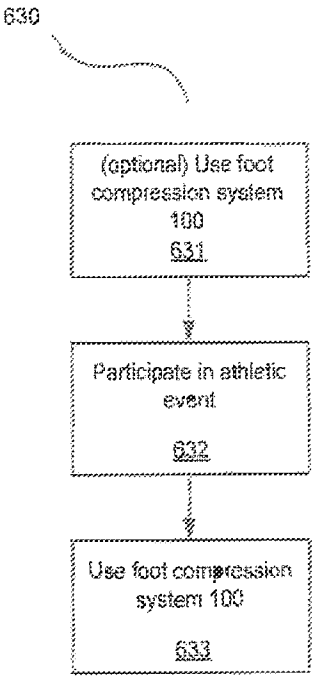
Figure 7A:
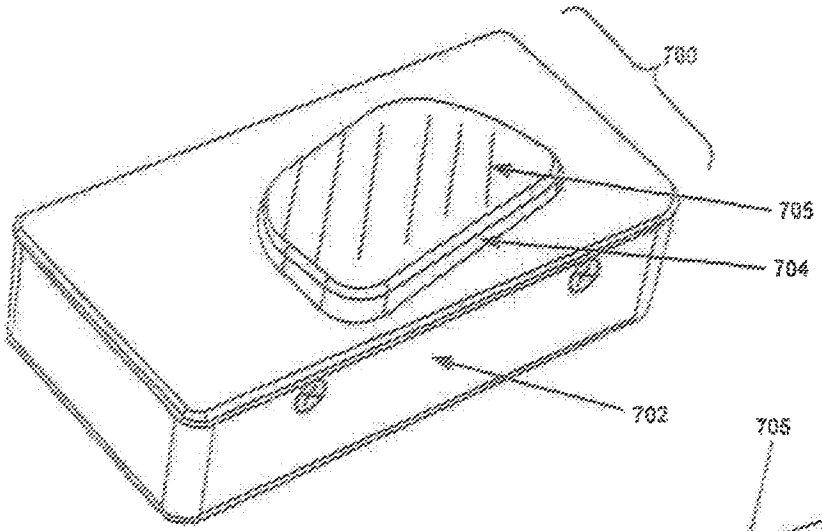
FIGS. 7A-7D illustrate a foot compression system in accordance with an exemplary embodiment.
Figure 7B:
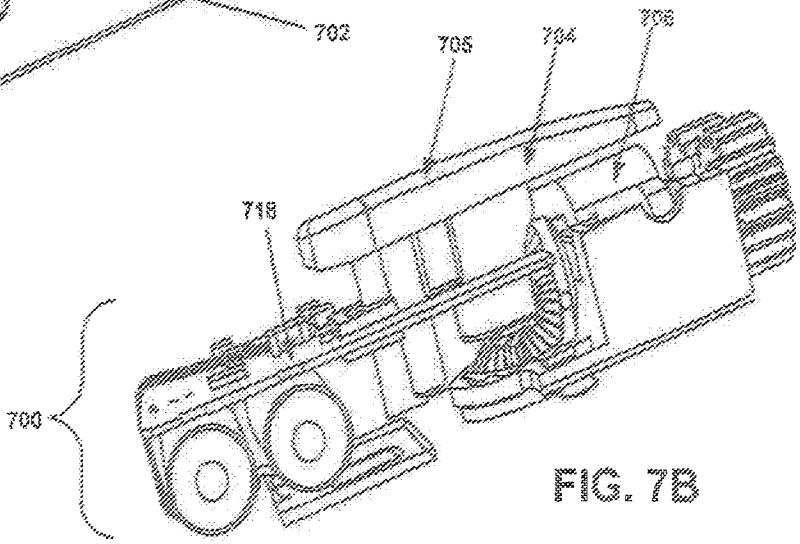
Figure 7C:
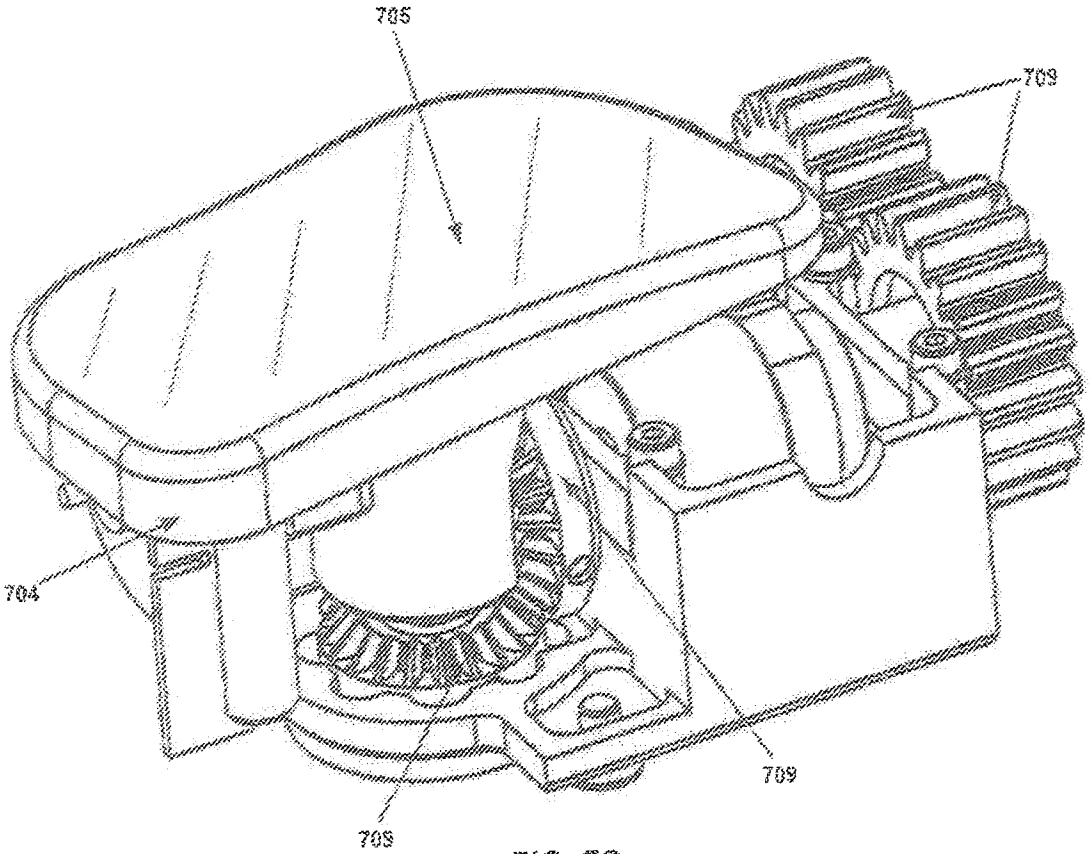
Figure 7D:
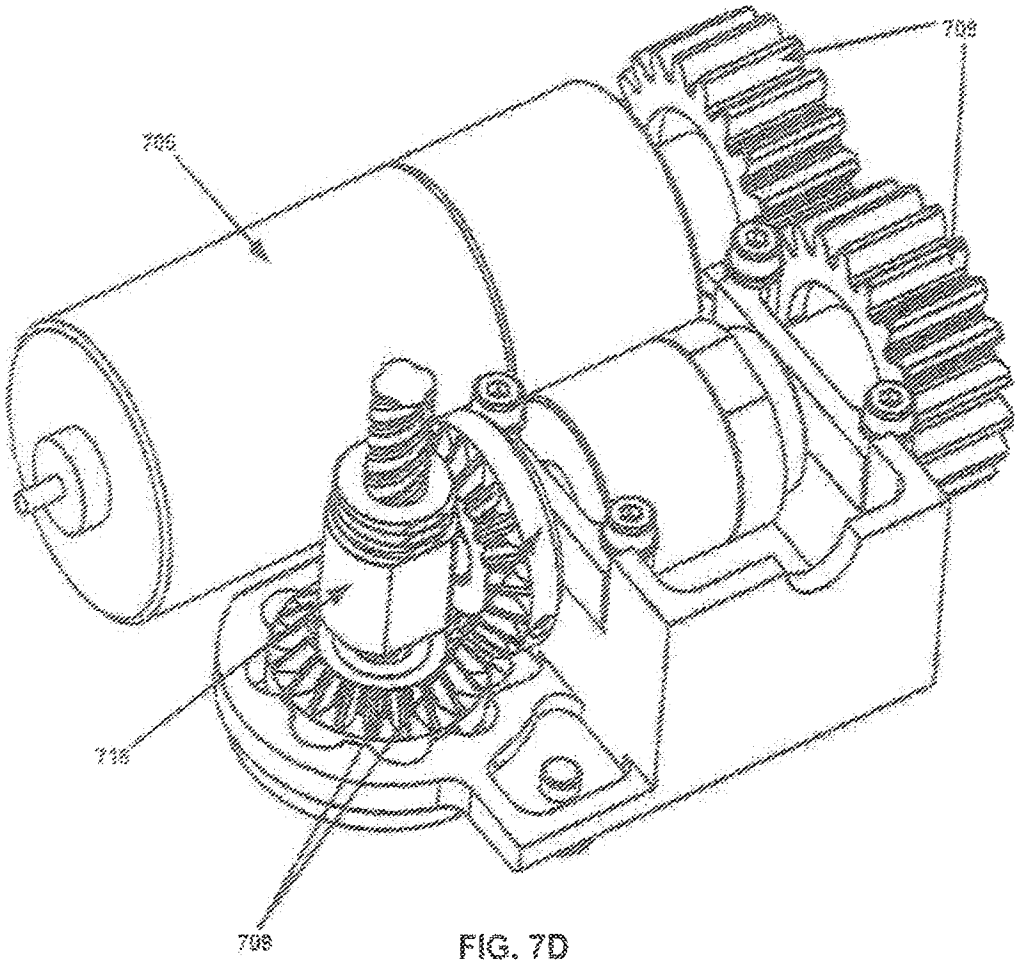

With momentary reference to FIG. 6A, in accordance with an exemplary embodiment a method 610 for implementing athletic recovery in a person following exercise comprises moving a pressure pad into contact with a foot (step 611), moving a pressure pad out of contact with the foot (step 612), and moving the pressure pad into contact with the foot (step 613). The pressure pad may be repeatedly moved as described above in order to facilitate blood flow. Turning now to FIG. 613, in accordance with an exemplary embodiment a method 620 for implementing athletic recovery in an athlete comprises: optionally, utilizing foot compression system 100 prior to an athletic event (step 621), participating in the athletic event (step 622), and utilizing foot compression system 100 subsequent to the athletic event (step 623). Each of steps 621 and 623 may comprise any suitable use of foot compression system 100, for example method 610. Moreover, steps 621 and/or 623 may be performed at any suitable time prior to and/or subsequent to the athletic event, and foot compression system 100 may be utilized for any desired length of time (for example, 15 minutes, 30 minutes, one hour, and/or the like). Moreover, foot compression system 100 may be utilized for a length of time specified by a physician.

In various exemplary embodiments, foot compression system 100 is configured for use by individuals who are in fixed, standing, and/or sitting positions for extended periods of time, for example office workers, pregnant women, passengers on long-haul airline flights in excess of four hours, individuals in wheelchairs, service workers whose positions require standing, hospital patients, and/or the like. By improving blood flow in the lower extremities and legs, foot compression system 100 can reduce the negative health impacts associated with extended standing, extended sitting, and/or reduced mobility or immobility of a portion of the body. Moreover, foot compression system 100 may be configured thr use in connection with the removal of metabolic waste, wound care and recovery, or the treatment of medical conditions including plantar fasciitis, restless leg syndrome, deep vein thrombosis, pulmonary embolism, venous insufficiency, and/or the like.

Turning now to FIGS. 7A-7D, in various exemplary embodiments a foot compression system 100, for example foot compression system 700, may be configured with various power transmission components, gearings, controls, and/or the like. In an exemplary embodiment, foot compression system 700 comprises main housing 702, pressure pad 704, pad top 705, motor 706, gears 709, slip clutch 716, and electrical components 718. Main housing 702 may be similar to main housing 102. Pressure pad 704 may be similar to pressure pad 104, and pad top 705 may be similar to pad top 105. Motor 706 may be similar to motor 106. Gears 709 may comprise any suitable number of and/or configuration of power transmission components configured to transfer power from motor 706 to pressure pad 104, for example spur gears, bevel gears, worm gears, and/or the like. Slip clutch 716 may be similar to slip clutch 116, and electrical components 718 may be similar to electrical components 118. Moreover, in various exemplary embodiments foot compression system 700 may be entirely self-contained; stated another way, foot compression system 700 may be configured as a stand-alone unit wherein all components necessary for operation of foot compression system 700 are contained within and/or physically coupled to main housing 702, and a separate reader portion is not utilized.

Figure 8:
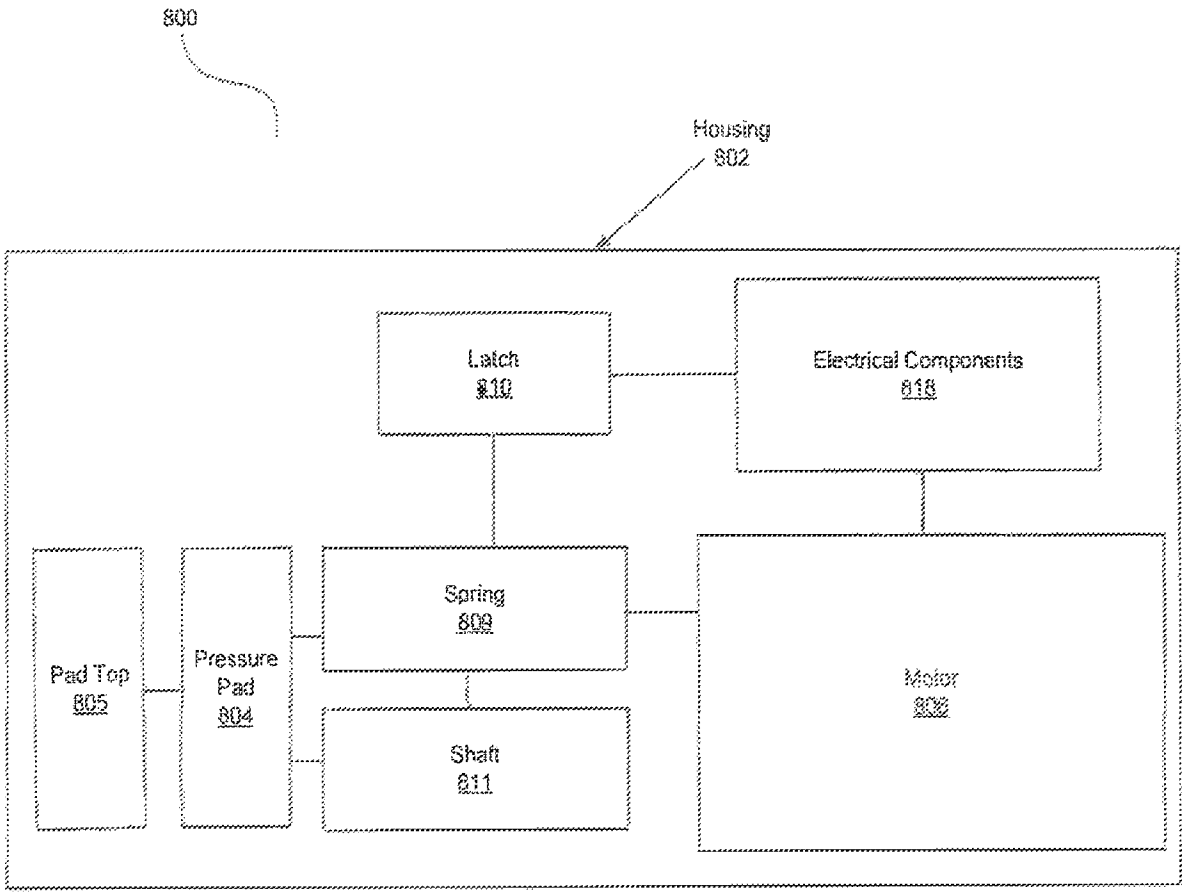
FIG. 8 illustrates a block diagram of a foot compression system in accordance with an exemplary embodiment.

Turning now to FIG. 8, in various exemplary embodiments a foot compression system 100, for example foot compression system 800, may be configured with various power transmission and/or storage components, gearings, controls, and/or the like. In an exemplary embodiment, foot compression system 800 comprises main housing 802, pressure pad 804, pad top 805, motor 806, spring 809, latch 810, and electrical components 818. Main housing 802 may be similar to main housing 102 and/or 702. Pressure pad 804 may be similar to pressure pad 104 and/or 704, and pad top 805 may be similar to pad top 105 and/or 705. Motor 806 may be similar to motor 106 and/or 706; moreover, motor 806 may be smaller, lighter, and/or less powerful than motor 106 and/or 706, for example in embodiments wherein motive force for pressure pad 804 is at least partially provided by spring 809 as discussed below.

In various exemplary embodiments, motor 806 comprises a primary drive and a reduction gearbox. In an exemplary embodiment, motor 806 comprises a DC brushless motor operable over a voltage range of between about 3 volts and about 12 volts. In certain exemplary embodiments, motor 806 is configured with a diameter of between about 5 mm and about 25 mm. In these exemplary embodiments, motor 806 is configured with an axial length of between about 15 mm and about 50 mm.

In various exemplary embodiments wherein motor 806 is a DC motor, motor 806 may be configured with a no-load current of between about 25 milliamps and about 50 milliamps. Motor 806 may be configured to draw up to about 250 milliwatts of power, and motor 806 may be operable over an RPM range of between about 1000 RPM and about 10,000 RPM. It will be appreciated that the foregoing performance ranges and parameters are by way of illustration only, and motor 806 may be configured as any suitable device configured to provide a suitable motive force or range of motive forces within foot compression system 800.

In certain exemplary embodiments, motor 806 comprises a Faulhaber 0620 B motor. In other exemplary embodiments, motor 806 comprises Smoovy Series 03A_S3 or Smoovy Series 06A_S2 motor manufactured by MicroMo Electronics of Clearwater, Fla.

In an exemplary embodiment, foot compression system 800 comprises spring 809 coupled to pressure pad 804. Spring 809 may be configured as a compression spring; moreover, spring 809 may be configured as a torsion spring. Spring 809 may comprise any suitable material capable of storing a compressive force and/or bending stress, for example "music wire" (ASTM A228), cold drawn carbon steels, hardened carbon steels, chrome silicon steel, chrome vanadium steel, austenitic stainless steels, and/or the like. Spring 809 may comprise a conical spring, a barrel spring, an hourglass spring, a cylindrical spring, and/or any other suitable spring shape, as desired. When configured as a compression spring, spring 809 may have a constant pitch; alternatively, spring 809 may have a variable pitch. For example, in an exemplary embodiment wherein spring 809 is a compression spring, spring 809 has a lower pitch toward the end of spring 809 coupled to pressure pad 804. In this manner, pressure pad 804 may press against a portion of a human body, for example a foot, in a more comfortable manner while still providing a suitably high compression force. Additionally, use of a variable pitch spring 809 allows pressure pad 804 to provide a suitable compressive three over a wider range of extension distances.

In certain exemplary embodiments, spring 809 is disposed about and/or coupled to a central shaft 811 coupling pressure pad 804 and other components of foot compression system 800. Central shaft 811 may be configured to provide guidance and/or stability to pressure pad 804 and/or spring 809. Central shaft 811 may telescope or otherwise extend and/or move, for example responsive to movement of pressure pad 804 and/or responsive to force exerted by spring 809.

In other exemplary embodiments, spring 809 is configured as a helical torsion spring, configured to exert an upwards force on pressure pad 804 so as to extend pressure pad 804 when spring 809 is released. Pressure pad 804 may extend and/or retract under the guidance of telescoping central shaft 811 as previously discussed.

In various exemplary embodiments wherein spring 809 is configured as a compression spring, spring 809 is configured with a free length of between about 5 mm and about 30 mm. In certain exemplary embodiments where spring 809 is configured as cylindrical, spring 809 is configured with a diameter of between about 3 mm and about 15 mm. Moreover, in various exemplary embodiments, spring 809 is configured with a spring constant of between about 9 pound-feet per inch and about 14 pound-feet per inch. In certain exemplary embodiments, spring 809 is configured with a spring constant of about 113 pound-feet per inch. In certain exemplary embodiments, spring 809 comprises part number C10-026-016 available from W.B. Jones Spring Company.

In various exemplary embodiments wherein spring 809 is configured as a torsion spring, spring 809 is configured with a torsion coefficient (also referred to as spring constant) of between about 2 inch-pounds per 360 degrees and about 40 inch-pounds per 360 degrees.

In various exemplary embodiments, spring 809 is compressed and/or twisted via operation of motor 806. Motor 806 and spring 809 may interact via a mechanical mechanism including one or more of a drive shaft, a scissor jack, a cam and lever, a rack and pinion, a turnbuckle, and a "credit card" mechanism. Motor 806 and spring 809 may interact via telescoping action, rotation, and/or the like.

In an exemplary embodiment, spring 809 is coupled to a rack and pinion mechanism configured to load spring 809 and retract pressure pad 804. The rack and pinion mechanism may be powered by motor 806. The rack and pinion mechanism and related spring 809 may be mounted in any suitable orientation and/or arrangement, for example vertically or horizontally mounted. Moreover, frictional and/or magnetic interfaces between motor 806 and spring 809 may also be utilized; additionally, gearing or other components configured to provide mechanical advantage may be located between motor 806 and spring 809.

When at least partially compressed and/or twisted, spring 809 permits coupled pressure pad 804 to retract and eventually assume a fully retracted position with respect to foot compression system 800, in an exemplary embodiment, motor 806 is configured to compress and/or twist spring 809 so as to retract pressure pad 804 a distance of about 15 mm over a time period of about 15 seconds. In another exemplary embodiment, motor 806 is configured to compress and/or twist spring 809 so as to retract pressure pad 804 a distance of about 15 mm over a time period of about 5 seconds.

Spring 809 may be held in an at least partially compressed position and/or twisted position by any suitable components and/or mechanisms, for example by a latch 810. Responsive to operation of latch 810, spring 809 is released and allowed to extend and/or untwist. Decompression and/or untwisting of spring 809 results in extension of pressure pad 804 to an extended position. After a suitable time period (as discussed extensively herein), pressure pad 804 may be retracted via compression and/or twisting of spring 809. Spring 809 may be latched and/or released via any suitable methods and/or mechanisms. In various exemplary embodiments, spring 809 may be latched and/or released via one or more of a catch and barb system, a pin release, a solenoid, a fluted shaft, an electromechanical coupling, an inertial coupling, a friction release, and/or the like.

In various exemplary embodiments, use of spring 809 allows elimination of a slip clutch and/or other similar components from foot compression system 800. When a user applies weight to pressure pad 804, for example by standing, spring 809 responds by at least partially compressing and/or twisting, allowing pressure pad 804 to at least partially retract. In this manner, potential damage to foot compression system 800 and/or potential discomfort and/or injury to a user are averted.

In various exemplary embodiments, electrical components 818 may be similar to electrical components 118. Moreover, electrical components 818 may be coupled to latch 810 and/or motor 806, for example in order to facilitate extension and retraction of pressure pad 804. Additionally, in various exemplary embodiments foot compression system 800 is entirely self-contained; stated another way, foot compression system 800 may be configured as a stand-alone unit wherein all components necessary for operation of foot compression system 800 are contained within and/or physically coupled to main housing 802, and a separate reader portion is not utilized.

It will be appreciated that various exemplary foot compression systems, for example foot compression system 100, foot compression system 700, and/or foot compression system 800, may each suitably be utilized in connection with methods of the present disclosure. As such, although the description of any particular method makes reference to a particular foot compression system, it will be appreciated that such method may also be carried out in connection with other foot compression systems as disclosed herein.

Figure 9:
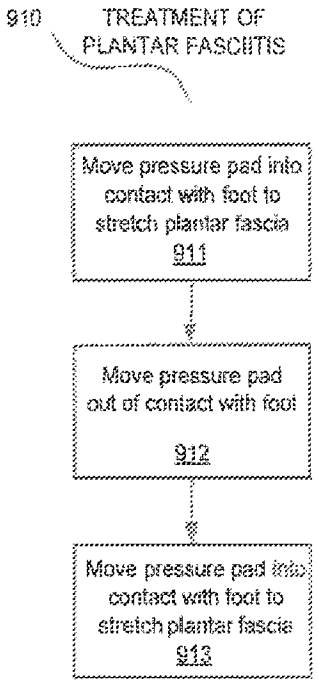
FIGS. 9-14 illustrate methods of using a foot compression system in accordance with various exemplary embodiments.

In various exemplary embodiments, with reference now to FIG. 9, a foot compression system (for example, foot compression system 100, foot compression system 700, and/or foot compression system 800) may be utilized in connection with treatment of plantar fasciitis. In these embodiments, activation of the foot compression system, for example foot compression system 800, is not primarily directed to increasing circulation and/or vascularity (though these results may be present); rather, activation of foot compression system 800 is directed to stretching, massaging, and/or otherwise treating the plantar fascia and/or the surrounding tissue and components of the foot. In an exemplary embodiment, foot compression system 800 is utilized to stretch the plantar fascia via extension of pressure pad 804.

In an exemplary embodiment, in connection with a method 910 for treating plantar fasciitis, pressure pad 804 is extended into contact with a foot in order to stretch the plantar fascia. Pressure pad 804 may be placed in contact with a foot (step 911) for a desired period of time in order to stretch the plantar fascia. In accordance with an exemplary embodiment, when moved to the fully extended position, pressure pad 804 may generate a pressure between about 1 mmHg and 250 mmHg against the person's foot. Further, pressure pad 804 may be extended with a force between about 25 Newtons and 80 Newtons in certain exemplary embodiments. Pressure pad 804 may be kept in an extended position for a time between about 1 second and about 6 seconds. Pressure pad 804 is then retracted (step 912). Pressure pad 804 may then be re-extended (step 913), such as after a delay of between about 10 and 60 seconds. However, other time frames can be used, and all suitable time frames are thought to fall within the scope of the present disclosure.

In various exemplary embodiments, when utilized for treatment of plantar fasciitis, foot compression system 800 may be utilized any suitable number of times in a day. In an exemplary embodiment, foot compression system 800 is used for treatment of plantar fasciitis once a day. In another exemplary embodiment, foot compression system 800 is used for treatment of plantar fasciitis twice a day. Moreover, foot compression system 800 may also be used more than twice a day, on alternating days, and/or on any other suitable time schedule, as desired.

In various exemplary embodiments, when utilized for treatment of plantar fasciitis, foot compression system 800 may be utilized for any suitable duration. In an exemplary embodiment, foot compression system 800 is used for treatment of plantar fasciitis for about 30 minutes at a time. In another exemplary embodiment, foot compression system 800 is used for treatment of plantar fasciitis for about one hour at a time. Moreover, foot compression system 800 may be used for between about fifteen minutes and about eight hours at a time, and/or for any other suitable duration, as desired.

Figure 10:
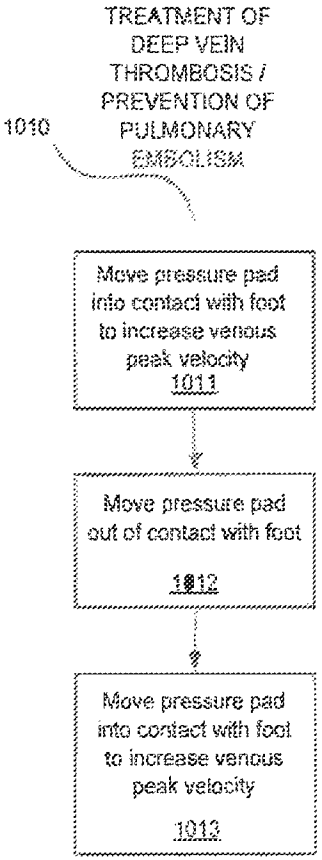

Turning now to FIG. 10, in various exemplary embodiments, foot compression system 800 may be utilized in connection with treatment of deep vein thrombosis and/or prevention of pulmonary embolism. In these embodiments, activation of foot compression system 800 may be primarily directed to increasing venous peak velocity. Additionally, improved circulation and/or vascularity may be achieved. In an exemplary embodiment, foot compression system 800 is utilized to increase venous peak velocity via extension of pressure pad 804.

In an exemplary embodiment, in connection with a method 1010 for treatment of deep vein thrombosis and/or prevention of pulmonary embolism, pressure pad 804 is extended into contact with a foot in order to force blood through the venous plexus. Pressure pad 804 may be placed in contact with a foot (step 1011) for a desired period of time in order to force blood through the venous plexus. In accordance with an exemplary embodiment, when moved to the fully extended position, pressure pad 804 may generate a pressure between about 1 mmHg and 500 mmHg against the person's foot. Further, pressure pad 804 may be extended with a force between about 50 Newtons and 12.5 Newtons in certain exemplary embodiments. Pressure pad 804 may be kept in an extended position for a time between about 1 and 3 seconds. Pressure pad 304 is then retracted (step 1012). Pressure pad 804 may then be re-extended (step 1013), such as after a delay of between about 20 and 40 seconds. However, other time frames can be used, and all suitable time frames are thought to fall within the scope of the present disclosure.

In various exemplary embodiments, in connection with a method 1010 for treatment of deep vein thrombosis and/or prevention of pulmonary embolism, extension of pressure pad 804 is configured to raise the peak femoral venous velocity in a patient via compression of the venous plexus. In an exemplary embodiment, compression of the venous plexus via extension of pressure pad 804 results in peak femoral venous velocity in excess of 30 centimeters per second (cm/s). In another exemplary embodiment, compression of the venous plexus via extension of pressure pad 804 results in peak femoral venous velocity in excess of 40 cm/s. In another exemplary embodiment, compression of the venous plexus via extension of pressure pad 804 results in peak femoral venous velocity in excess of 45 cm/s. Moreover, foot compression system 800 may be utilized to compress the venous plexus in order to achieve any suitable peak femoral venous velocity in a patient, and the foregoing examples are by way of illustration and not of limitation.

In various exemplary embodiments, when utilized for treatment of deep vein thrombosis and/or prevention of pulmonary embolism, foot compression system 800 may be utilized any suitable number of times in a day. In an exemplary embodiment, foot compression system 800 is used for treatment of treatment of deep vein thrombosis and/or prevention of pulmonary embolism once a day. In another exemplary embodiment, foot compression system 800 is used for treatment of deep vein thrombosis and/or prevention of pulmonary embolism twice a day. Moreover, foot compression system 800 may also be used more than twice a day, on alternating days, continuously, and/or on any other suitable time schedule, as desired.

In various exemplary embodiments, when utilized for treatment of deep vein thrombosis and/or prevention of pulmonary embolism, foot compression system 800 may be utilized for any suitable duration, in an exemplary embodiment, foot compression system 800 is used 24 hours a day. In another exemplary embodiment, foot compression system 800 is used for treatment of deep vein thrombosis and/or prevention of pulmonary embolism for about 12 hours at a time. Moreover, foot compression system 800 may be used for between about three hours and about 6 hours at a time, and/or for any other suitable duration, as desired.

Figure 11:
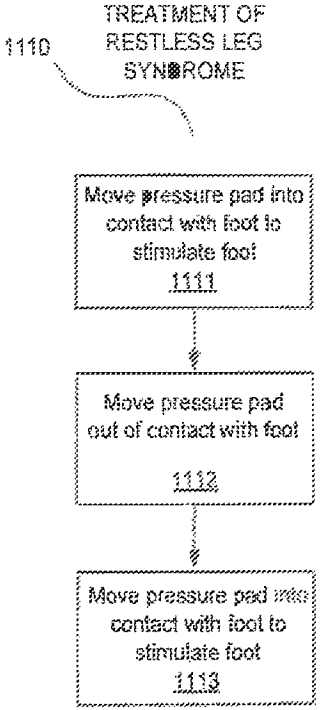

Turning now to FIG. 11, in various exemplary embodiments, foot compression system 800 may be utilized in connection with treatment of restless leg syndrome. In these embodiments, activation of foot compression system 800 may be directed to increasing blood flow in the foot and/or leg, stimulation of nerves in the foot and/or leg, and/or the like. Additionally, improved circulation and/or vascularity may be achieved. In an exemplary embodiment, foot compression system 800 is utilized to stimulate the foot via extension of pressure pad 804.

In an exemplary embodiment, in connection with a method 1110 for treating restless leg syndrome, pressure pad 804 is extended into contact with a foot in order to stimulate the foot. Pressure pad 804 may be placed in contact with a foot (step 1111) for a desired period of time in order to stimulate the foot. In accordance with an exemplary embodiment, when moved to the fully extended position, pressure pad 804 may generate a pressure between about 1 mmHg and 300 mmHg against the person's foot. Further, pressure pad 804 may be extended with a force between about 25 Newtons and 75 Newtons in certain exemplary embodiments. Pressure pad 804 may be kept in an extended position for a time between about 1 and 3 seconds. Pressure pad 804 is then retracted (step 1112). Pressure pad 804 may then be re-extended (step 1113), such as after a delay of between about 20 and 30 seconds. However, other time frames can be used, and all suitable time frames are thought to fall within the scope of the present disclosure.

In various exemplary embodiments, when utilized for treatment of restless leg syndrome, foot compression system 800 may be utilized any suitable number of times in a day. In an exemplary embodiment, foot compression system 800 is used for treatment of restless leg syndrome once a day, for example between about 1 hour and about 3 hours before retiring to bed. In another exemplary embodiment, foot compression system 800 is used for treatment of restless leg syndrome twice a day, for example within about 1 hour and about 3 hours of arising in the morning, and between about 1 hour and about 3 hours before retiring to bed. Moreover, foot compression system 800 may also be used more than twice a day, on alternating days, and/or on any other suitable time schedule, as desired. In certain exemplary embodiments, foot compression system 800 may be utilized on an "as-needed" basis to treat symptoms of restless leg syndrome in real-time as they are occurring.

In various exemplary embodiments, when utilized for treatment of restless leg syndrome, foot compression system 800 may be utilized for any suitable duration. In an exemplary embodiment, foot compression system 800 is used fir treatment of restless leg syndrome for between about one hour and about three hours at a time. Moreover, foot compression system 800 may be used for any other suitable duration, as desired.

Figure 12:
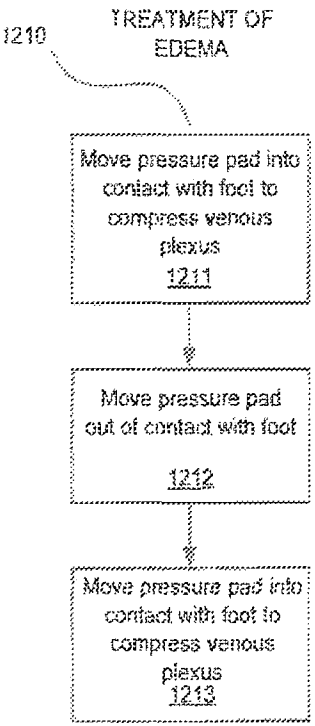
Figure 15:
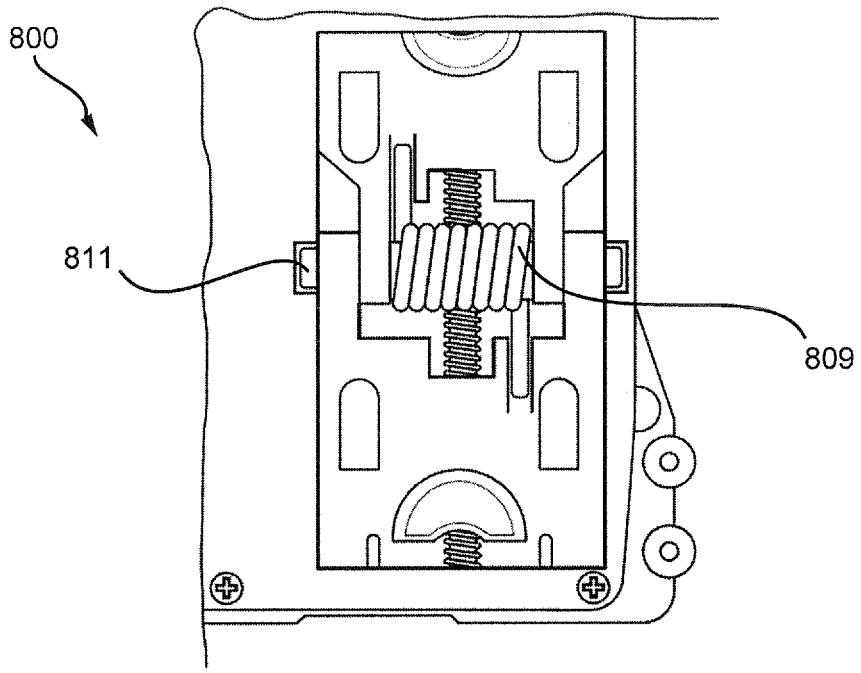
FIGS. 15-16 illustrate a top view of a portion of a foot compression system in accordance with an exemplary embodiment.
Figure 16:
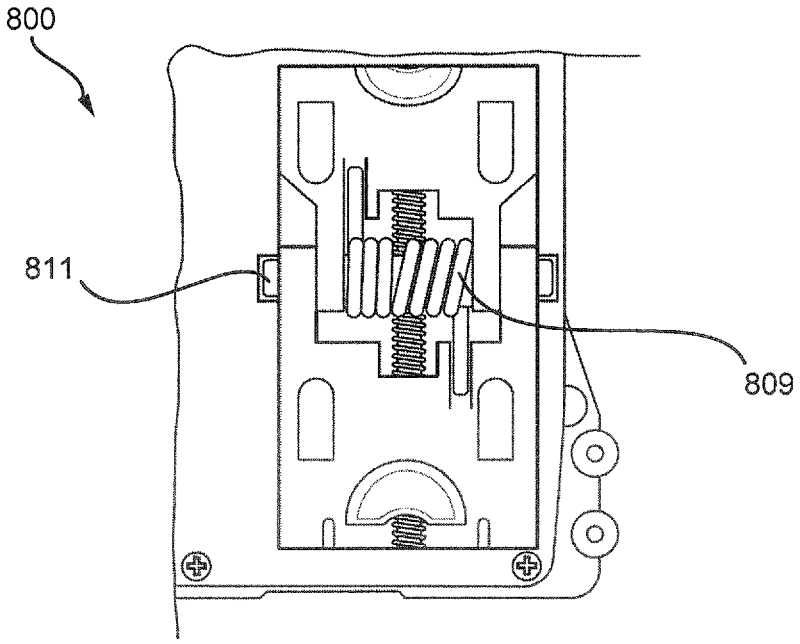
Figure 17:
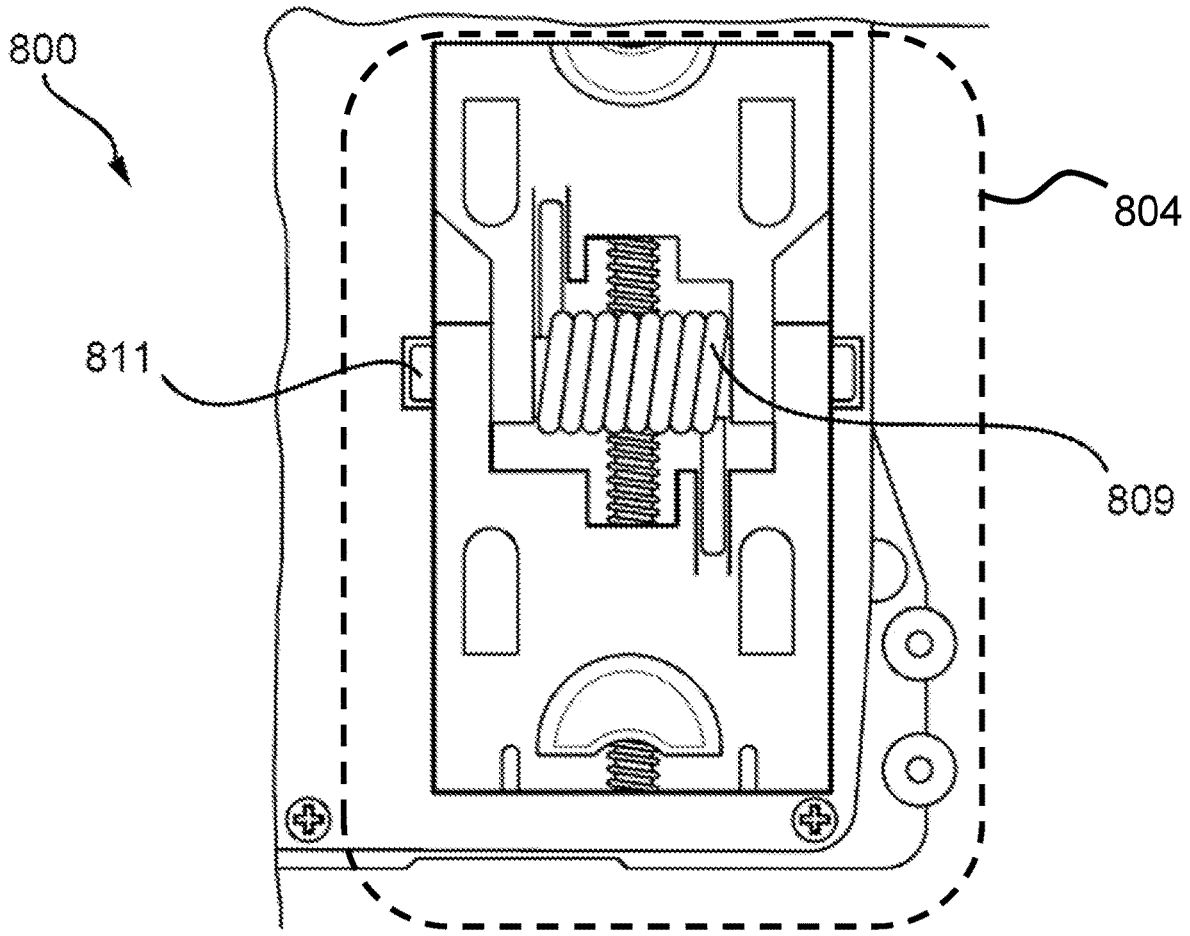
FIG. 17 illustrates a top view of a portion of a foot compression system in accordance with an exemplary embodiment.

Turning now to FIG. 12, in various exemplary embodiments, foot compression system 800 may be utilized in connection with treatment of edema. In these embodiments, activation of foot compression system 800 may be directed to increasing circulation and/or vascularity in a portion of a human body. In an exemplary embodiment, foot compression system 800 is utilized to compress the venous plexus region of the foot via extension of pressure pad 804.

In an exemplary embodiment, in connection with a method 1210 for treating edema, pressure pad 804 is extended into contact with a foot in order to force blood from the venous plexus region of the foot. Pressure pad 804 may be placed in contact with a foot (step 1211) for a desired period of time in order to force blood from the venous plexus. In accordance with an exemplary embodiment, when moved to the fully extended position, pressure pad 804 may generate a pressure between about 1 mmHg and 500 mmHg against the person's foot. Further, pressure pad 804 may be extended with a three between about 25 Newtons and 125 Newtons in certain exemplary embodiments. Pressure pad 804 may be kept in an extended position fix a time between about 1 second and about 5 seconds. Pressure pad 804 is then retracted (step 1212) in order to allow the venous plexus to at least partially refill with blood. Pressure pad 804 may then be re-extended (step 1213) to force blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of edema, foot compression system 800 may be utilized any suitable number of times in a day. In an exemplary embodiment, foot compression system 800 is used for treatment of edema once a day. In another exemplary embodiment, foot compression system 800 is used for treatment of edema twice a day. Moreover, foot compression system $00 may also be used more than twice a day, on alternating days, and/or on any other suitable time schedule, as desired. In certain exemplary embodiments, foot compression system 800 may be utilized on an "as-needed" basis to treat symptoms of edema in real-time, for example responsive to patient discomfort.

In various exemplary embodiments, when utilized fix treatment of edema, foot compression system 800 may be utilized for any suitable duration. In an exemplary embodiment, foot compression system 800 is used for treatment of edema for between about one hour and about eight hours at a time. Moreover, foot compression system 800 may be used for any other suitable duration, as desired.

Figure 13:
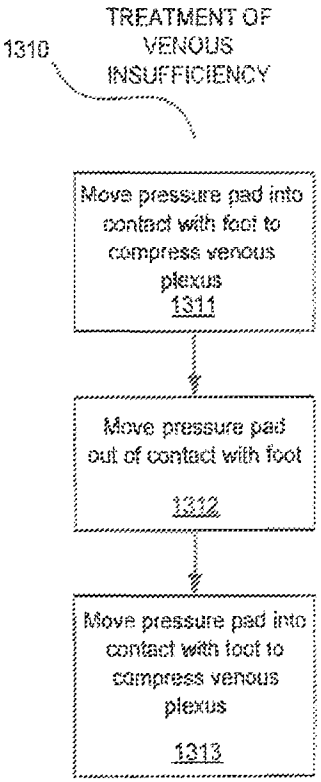

Turning now to FIG. 13, in various exemplary embodiments, foot compression system 800 may be utilized in connection with treatment of venous insufficiency, in these embodiments, activation of foot compression system 800 may be directed to increasing circulation, counteracting the effect of damaged valves in one or more veins, and/or the like. In an exemplary embodiment, foot compression system 800 is utilized to compress the venous plexus region of the foot via extension of pressure pad 804.

In an exemplary embodiment, in connection with a method 1310 for treating venous insufficiency, pressure pad 804 is extended into contact with a foot in order to force blood from the venous plexus region of the foot. Pressure pad 804 may be placed in contact with a foot (step 1311) for a desired period of time in order to force blood from the venous plexus. In accordance with an exemplary embodiment, when moved to the fully extended position, pressure pad 804 may generate a pressure between about 1 mmHg and 500 mmHg against the person's foot. Further, pressure pad 804 may be extended with a force between about 25 Newtons and 12.5 Newtons in certain exemplary embodiments. Pressure pad 804 may be kept in an extended position for a time between about 1 second and about 5 seconds. Pressure pad 804 is then retracted (step 1312) in order to allow the venous plexus to at least partially refill with blood. Pressure pad 804 may then be re-extended (step 1313) to throe blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of venous insufficiency, foot compression system 800 may be utilized any suitable number of times in a day. In an exemplary embodiment, foot compression system 800 is used for treatment of venous insufficiency once a day. In another exemplary embodiment, foot compression system 800 is used for treatment of venous insufficiency twice a day. Moreover, foot compression system 800 may also be used more than twice a day, on alternating days, and/or on any other suitable time schedule, as desired. In certain exemplary embodiments, foot compression system 800 may be utilized on an "as-needed" basis to treat symptoms of venous insufficiency in real-time, for example responsive to patient discomfort.

In various exemplary embodiments, when utilized for treatment of venous insufficiency, foot compression system 800 may be utilized for any suitable duration. In an exemplary embodiment, foot compression system 800 is used for treatment of venous insufficiency for between about one hour and about twelve hours at a time. Moreover, foot compression system 800 may be used for any other suitable duration, as desired.

Figure 14:
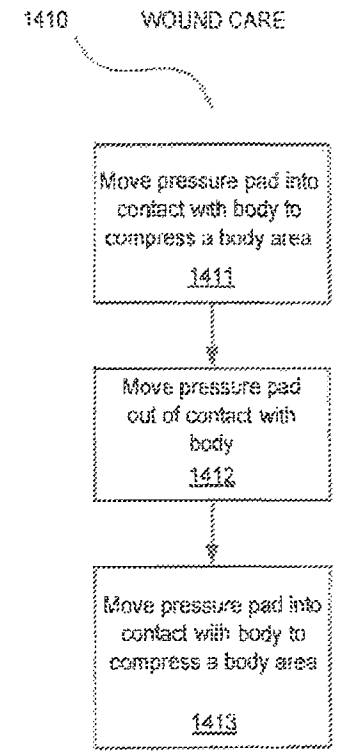

Turning now to FIG. 14, in various exemplary embodiments, foot compression system 800 may be utilized in connection with treatment of wounds. In these embodiments, activation of foot compression system 800 may be directed to increasing blood circulation and/or vascularity at and/or around a wound site. Moreover, in connection with wound care, use of foot compression system 800 may be guided and/or governed by the circulatory capacity of the body in the region of a wound. Stated another way, foot compression system 800 may be configured to increase circulation in the region of a wound without exceeding the circulatory capacity of the region of the wound. In an exemplary embodiment, foot compression system 800 is utilized to compress a portion of the body, for example the venous plexus region of the foot, via extension of pressure pad 804.

In an exemplary embodiment, in connection with a method 1410 for wound care, pressure pad 804 is extended into contact with a portion of a body, for example a foot, in order to force blood from the portion of the body and/or otherwise assist in "pumping" blood through a region of the body. Pressure pad 804 may be placed in contact with the body (step 1411) for a desired period of time in order to force blood therethrough. In accordance with an exemplary embodiment, when moved to the fully extended position, pressure pad 804 may generate a pressure between about 1 mmHg and 200 mmHg against the body. Further, pressure pad 804 may be extended with a force between about 12 Newtons and 75 Newtons in certain exemplary embodiments. Pressure pad 804 may be kept in an extended position for a time between about 1 second and about 5 seconds. Pressure pad 804 is then retracted (step 1412) in order to allow the portion of the body to at least partially refill with blood. Pressure pad 804 may then be re-extended (step 1413) to force blood from the portion of the body, such as after a delay of between about 30 seconds and about 60 seconds. However, other time frames can be used, and all suitable time frames are thought to fall within the scope of the present disclosure.

In various exemplary embodiments, when utilized for wound care, foot compression system 800 may be utilized any suitable number of times in a day. In an exemplary embodiment, foot compression system 800 is used for wound care once a day. In another exemplary embodiment, foot compression system 800 is used for wound care twice a day. Moreover, foot compression system 100 may also be used more than twice a day, on alternating days, and/or on any other suitable time schedule, as desired. In certain exemplary embodiments, foot compression system 800 may be utilized on a continuous basis to provide a steadily elevated level of circulation in the region of a wound.

In various exemplary embodiments, when utilized for wound care, foot compression system 300 may be utilized for any suitable duration. In an exemplary embodiment, foot compression system 800 is used for wound care for between about one hour and about 24 hours at a time. Moreover, foot compression system 800 may be used for any other suitable duration, as desired.

It will be appreciated that various steps of the foregoing methods, for example extending a pressure pad into contact with a portion of the body, removing a pressure pad from contact with a portion of the body, and so forth, may be repeated as suitable in order to achieve a desired outcome.

The present disclosure has been described above with reference to various exemplary embodiments. However, those skilled in the art will recognize that changes and modifications may be made to the exemplary embodiments without departing from the scope of the present disclosure. For example, the various operational steps, as well as the components for carrying out the operational steps, may be implemented in alternate ways depending upon the particular application or in consideration of any number of cost functions associated with the operation of the system, e.g., one or more of the steps may be deleted, modified, or combined with other steps. Further, it should be noted that while the methods and systems for compression described above are suitable for use on the foot, similar approaches may be used on the hand, calf, or other areas of the body. These and other changes or modifications are intended to be included within the scope of the present disclosure.

Moreover, as will be appreciated by one of ordinary skill in the art, principles of the present disclosure may be reflected in a computer program product on a tangible computer-readable storage medium having computer-readable program code means embodied in the storage medium. Any suitable computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create means for implementing the functions. These computer program instructions may also be stored in a computer-readable memory that can direct a computer or other programmable data processing apparatus to function in a particular manner, such that the instructions stored in the computer-readable memory produce an article of manufacture including instruction means which implement the function specified. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified.

In the foregoing specification, the disclosure has been described with reference to various embodiments. However, one of ordinary skill in the art appreciates that various modifications and changes can be made without departing from the scope of the present disclosure as set forth in the claims below. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. Further, when language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A foot compression system, comprising:

a retractable, non-bendable pressure pad;

a spring coupled directly to the pressure pad and disposed about a central shaft, the spring configured to move the pressure pad into contact with a foot; and a mechanism coupled to the spring, the mechanism operable to move the pressure pad out of contact with the foot by storing energy in the spring, wherein the spring comprises a torsion spring, wherein the central shaft is configured to extend responsive to movement of the pressure pad, and wherein the foot compression system is completely contained within an item of footwear.

2. The system of claim 1, wherein the mechanism stores energy in the spring at set time intervals that are preprogrammed within the foot compression system.

3. The system of claim 1, further comprising a latch configured to hold the spring in a compressed position and to release the spring to move the pressure pad.

4. The system of claim 1, further comprising a power supply coupled to the mechanism, wherein the power supply is completely contained within the item of footwear.

5. The system of claim 1, further comprising the item of footwear, wherein the footwear is configured with a flexible sole.

6. The system of claim 1, wherein the mechanism is an electric motor.

7. The system of claim 1, further comprising a sensor operable to determine whether a user of the system is walking, and wherein, responsive to input from the sensor, the pressure pad is not extended when the user of the system is walking.

8. A method, comprising:

extending a retractable, non-bendable pressure pad into contact a first time with the venous plexus region of a foot to apply pressure to the venous plexus region of the foot, wherein the pressure pad and a spring are both completely contained within an item of footwear, wherein the spring comprises a torsion spring disposed about a central shaft configured to extend responsive to movement of the pressure pad, and wherein the pressure pad is coupled directly to the spring;

holding the pressure pad in contact with the venous plexus region of the foot for a period exceeding a selected duration;

retracting, via an electric motor coupled to the spring, the pressure pad out of contact with the foot by at least one of compressing or twisting the spring; and extending, via the spring, the pressure pad into contact a second time with the venous plexus region of the foot.

9. The method of claim 8, wherein the extending the second time is responsive to an elapsed time from the retracting exceeding 15 seconds.

10. The method of claim 8, wherein the selected duration is 1 second.

11. A method of treating or preventing a medical condition selected from a group comprising deep vein thrombosis, edema, restless leg syndrome, venous insufficiency, plantar fasciitis, pulmonary embolism, or a wound, comprising:

moving, by a torsion spring, a pressure pad a first time to bring the pressure pad into contact with a portion of a human body to compress the portion of the human body;

moving, by a mechanism, the pressure pad a second time to bring the pressure pad out of contact with the portion of a human body to allow the portion of the human body to at least partially refill with blood;

moving, by the torsion spring, the pressure pad a third time to bring the pressure pad into contact with the portion of the human body to compress the portion of the human body, wherein the spring, the mechanism, the pressure pad, and a power source for the mechanism are located entirely within an item of footwear, and wherein the torsion spring is disposed about a central shaft configured to extend responsive to movement of the pressure pad.

12. The method of claim 11, wherein the mechanism is an electric motor.

13. A foot compression system, comprising:

a non-bendable pressure pad;

a spring coupled directly to the pressure pad, the spring configured to move the pressure pad into contact with a foot, wherein the spring comprises a torsion spring disposed about a central shaft, and wherein the central shaft is configured to extend responsive to movement of the pressure pad;

an electric motor coupled to the spring, the electric motor operable to move the pressure pad out of contact with the foot by storing energy in the spring;

a latch configured to hold the spring in a compressed position and to release the spring to move the pressure pad; and a power supply configured to supply electricity to the electric motor, wherein the foot compression system is completely contained within an item of footwear having a flexible sole.

14. The system of claim 13, further comprising:

a compressible pad top coupled to the pressure pad, the compressible top configured to compress upon contact with a foot; and electrical components configured to control operation of the motor and the latch.

* * * * *